US005931101A

United States Patent [19]

Kaufhold et al.

[11] Patent Number: 5,931,101

[45] Date of Patent: Aug. 3, 1999

[54] LIGHT WEIGHT DRAFT SILL

[75] Inventors: Horst T. Kaufhold, Aurora; Douglas L. Compton, Bolingbrook; Brian A. Toussaint, Lisle; Ronald G. Butler, Mundelein, all of Ill.

[73] Assignee: Amsted Industries Incorporated, Chicago, Ill.

[21] Appl. No.: 08/885,643

[22] Filed: Jun. 30, 1997

[51] Int. Cl.[6] ..... B61D 17/00

[52] U.S. Cl. ..... 105/420; 213/51; 213/57

[58] Field of Search ..... 105/199.4, 416, 105/420; 213/51, 56, 57

[56] References Cited

U.S. PATENT DOCUMENTS

| | | | |
|---|---|---|---|
| 2,638,233 | 5/1953 | Wolfe | 105/420 |
| 3,561,370 | 2/1971 | Reynolds | 213/57 |
| 4,128,062 | 12/1978 | Roberts | 105/420 |
| 4,252,068 | 2/1981 | Nolan | 105/420 |
| 4,359,003 | 11/1982 | Miller et al. | 105/420 |
| 4,445,617 | 5/1984 | Elliott | 105/420 |
| 4,549,666 | 10/1985 | Altherr et al. | 105/420 |
| 5,135,117 | 8/1992 | Geis | 213/57 |

OTHER PUBLICATIONS

1970 Car and Locomotive Cyclopedia of American Practice, Second Edition pp. 334–339, 557, 566 and 586–587.

*Primary Examiner*—S. Joseph Morano
*Attorney, Agent, or Firm*—Edward J. Brosius; F. S. Gregorczyk; Stephen J. Manich

[57] ABSTRACT

The present invention provides a lightweight draft sill end casting for use with railroad cars. Weight reductions are achieved and adequate strength is maintained by using a set of front ribs and back ribs, with angled top and bottom ribs. The back rib set has a single central rib along the central plane of the draft sill. A single horizontal center plate rib is also used in the area of the center plate. The side ribs at the center plate have larger lightener holes. Holes are also provided in the bottom wall of the casting. Larger lightener holes are provided in the area of the draft sill pocket. These holes are moved upwardly to lower the center of gravity of the draft sill. The draft stops may be spaced from the top wall of the draft sill and from the bottoms of the side walls.

40 Claims, 8 Drawing Sheets

LIGHT WEIGHT DRAFT SILL

FIELD OF THE INVENTION

The present invention relates to cast draft sill structures and railroad car center sill structures.

BACKGROUND OF THE INVENTION

Prior art railroad cars have employed cast draft sill structures, and have included cast draft sills welded into car center sill structures.

Draft sills have been used to receive and house coupler systems for coupling one railroad car to another. Buff and draft forces are generally transferred between the draft sill structure, the car truck and the center sill of the car. More particularly, the draft sill structure typically receives a coupler and a yoke or other coupler mounting structure such as a draw bar and a cushioning or shock-absorbing assembly.

Continued attempts have been made to decrease the weight of the cars to allow for reduced energy consumption and more efficient rail transport. It has been desirable to produce railroad freight car components that are relatively lightweight and that can accommodate new car designs. In some instances, attempts have been made to reduce the weight of the draft sills themselves. Attempts have been made to produce lighter weight fabricated draft sills instead of using cast structures.

In addition, the Association of American Railroads (AAR) has set requirements for the strength of draft sill structures. For example, the rear stops must be capable of withstanding a 1000 Klbs static buff load without failure, and future AAR requirements will require that the front stops be capable of withstanding a 900 Klbs static draft force. Given these strength requirements, it has been problematic to provide a lightweight cast draft sill that meets AAR strength requirements.

SUMMARY OF THE INVENTION

The present invention addresses the need to reduce the weight of a railroad freight car draft sill end casting while maintaining adequate strength to meet AAR requirements. Some of the features of the present invention may also be useful in reducing the weight of fabricated draft sills. It should be understood that various aspects of the invention may be used singly or in combinations of some or all of the aspects of the invention.

In one aspect, the present invention provides a draft sill to receive a shank of a device for connecting one railroad car to another. The draft sill comprises a top wall and a pair of side walls depending from the top wall. Each side wall has a bottom opposite the top wall. An interior is defined by the side walls and top wall. There is a theoretical force line corresponding with a design position of a longitudinal center line of the shank of the connecting device when to be received in the interior of the draft sill. The draft sill includes a pair of front stops on the side walls in the interior of the draft sill. One front stop extends from each side wall toward the other. The draft sill also includes a pair of rear stops on the side walls in the interior of the draft sill. One rear stop extends from each side wall toward the other. The front and rear stops are separated from each other, and the space between the front and rear stops defines a pocket. A lightener hole extends through each side wall of the draft sill defining the pocket. Each lightener hole has a centerline and the theoretical force line is between the lightener hole centerline and the bottoms of the side walls.

In another aspect, the present invention provides a draft sill comprising a top wall, a pair of side walls depending from the top wall and an interior defined by the side walls and top wall. A pair of front stops are on the side walls in the interior of the draft sill. The front stops extend toward one another. A pair of rear stops are on the side walls in the interior of the draft sill. The rear stops extend toward one another. The front and rear stops are separated from each other, and the space between the front and rear stops defines a pocket. A lightener hole extends through each side wall of the draft sill defining the pocket. The open area defined by the lightener hole in the two side walls is greater than 38.18 square inches.

In another aspect, the present invention provides a draft sill for use with a railroad car. The draft sill comprises a front end, a back end opposite the front end, a top wall and a pair of side walls depending from the top wall. Each side wall has a bottom opposite the top wall. An interior is defined by the side walls and top wall. The draft sill has a front stop on each side wall within the interior of the draft sill. The front stops on the two side walls are opposed to each other and extend toward one another in the interior of the draft sill. The draft sill also includes a rear stop on each side wall within the interior of the draft sill. The rear stops on the two side walls are opposed to each other and extend toward one another in the interior of the draft sill. A front rib set is associated with each front stop. Each front rib set includes top and bottom key slot ribs extending from the front stop toward the front end of the draft sill. The top and bottom key slot ribs have spaced substantially parallel surfaces separated by a key slot in the side wall. The key slot has a central axis parallel with the top wall of the draft sill. A top rib extends from the front stop to the top wall and the side wall. The top rib has a bottom surface. The top rib is shaped so that a plane parallel with a length of the top rib bottom surface defines an acute angle with the plane of the top wall. The top rib is the only rib between the top key slot rib and the top wall of the draft sill. A bottom rib extends from the front stop toward the front end and toward the bottom of the side wall. The bottom rib has a top surface. The bottom rib top surface is shaped so that a plane parallel with a length of the bottom rib top surface defines an acute angle with the plane of the bottoms of the side walls of the draft sill. The bottom rib is the only rib between the bottom key slot rib and the bottom portion of the draft sill. A rear rib set is associated with each rear stop.

In another aspect the present invention provides a draft sill for use with a railroad car. The draft sill comprises a front end, back end, top wall and a pair of side walls depending from the top wall. Each side wall has a bottom opposite the top wall. The draft sill has an interior defined by the side walls and top wall. The draft sill also has a front stop on each side wall and within the interior of the draft sill. The front stops on the two side walls are opposed to each other and extend toward one another in the interior of the draft sill. The draft sill has a rear stop on each side wall and within the interior of the draft sill. The rear stops on the two side walls are opposed to each other and extend toward one another in the interior of the draft sill. A front rib set is associated with each front stop. A rear rib set is associated with each rear stop. Each rear rib set includes a rear central rib extending from the rear stop toward the back end of the draft sill. The rear central rib joins the side wall and has a back end opposite the juncture with the rear stop. The central rib has top and bottom surfaces. The rear rib set also includes a rear top rib extending from the rear stop toward the top wall and toward the side wall. The top rib has a bottom surface shaped so that a plane parallel with a length of the bottom surface defines an acute angle with the plane of the top wall. The rear top rib is the only rib between the central rib and the top wall along the rear stop. The rear rib set also includes a rear bottom rib extending from the rear stop toward the bottom of the side wall of the draft sill. The rear bottom rib has a top surface shaped so that a plane parallel with a length of the top surface defines an acute angle with the plane of the bottoms of the side walls. The rear bottom rib is the only rib between the central rib and the bottom of the side wall along the rear stop.

In another aspect the present invention provides a draft sill for use with a railroad car. The draft sill comprises a front end, back end, top wall and a pair of side walls depending from the top wall. Each side wall has a bottom opposite the top wall. A bottom wall extends between a portion of the bottoms of the sidewalls. A center plate depends from the bottom wall. An interior is defined by the side walls and top wall. A front stop is on each side wall within the interior of the draft sill. The front stops on the two side walls are opposed to each other and extend toward one another in the interior of the draft sill. A rear stop is on each side wall and within the interior of the draft sill. The rear stops on the two side walls are opposed to each other and extend toward one another in the interior of the draft sill. The draft sill has a rear rib set associated with each rear stop. Each rear rib set includes a rear central rib that extends from the rear stop toward the back end of the draft sill. The rear central rib joins the side wall and has a back end opposite the juncture with the rear stop. Each rear rib set also includes a rear top rib on one side of the rear central rib and a rear bottom rib on the other side of the rear central rib. There is an open member that extends up from the center plate toward the top wall and disposed between the rear rib set and the back end of the draft sill. The draft sill has a vertical center plate rib disposed between the center plate and the top wall between the open member and the rear rib set. A horizontal center plate rib extends between the sidewalls and the vertical center plate rib. The horizontal center plate rib is spaced from the back end of the rear central rib. A space between the rear central rib and vertical and horizontal center plate ribs is free from any ribs.

In another aspect the present invention provides a draft sill comprising a front end, a back end, a top wall, side walls depending from the top wall, and a bottom wall extending between a portion of the side walls. The draft sill has an interior defined by the side walls and top wall. A center plate depends from the bottom wall. The draft sill has a vertical rib extending between the top wall and the center plate. A horizontal center plate rib is substantially parallel with the top wall and extends between the side walls and the vertical rib. The interior of the draft sill between the horizontal center plate rib and the top wall is free from horizontal ribs and the interior of the draft sill between the horizontal center plate rib and the bottom wall is free from horizontal ribs.

In another aspect the present invention provides a draft sill comprising a top wall and a pair of side walls depending from the top wall. An interior is defined by the side walls and top wall. There is a front stop on each side wall in the interior of the draft sill. The front stops extend from the side walls toward one another. A rear stop is on each side wall in the interior of the draft sill. The rear stops extend from the side walls toward one another. The front and rear stops are separated from each other, and the space between the front and rear stops defines a pocket. Each front and rear stop has a stop face perpendicular to the side wall and lying in a plane perpendicular to the top wall. At least one pair of stops each have a recess between the stop and the top wall of the draft sill so that the stop faces of the pair of stops are spaced from the top wall of the draft sill.

DETAILED DESCRIPTION

Figure 1:
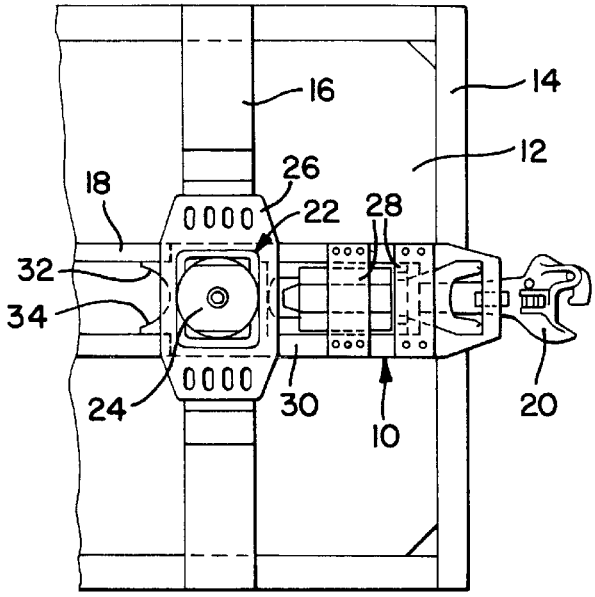
FIG. 1 PRIOR ART
FIG. 1 is a bottom plan view of a prior art railroad freight car body with a prior art draft sill and coupler in place.

FIG. 1 shows a prior art cast draft sill 10 mounted to the structure of a railroad freight car 12. In this mounted position the cast draft sill 10 is secured to the end sill 14, the body bolster 16 and the center sill 18. The illustrated prior art cast draft sill 10 has draft gear mounted within the draft gear pocket and the coupler 20 has its shank extend through the coupler shank opening at the outboard end thereof. A center filler plate, indicated generally at 22, is mounted in the center filler plate pocket of the cast draft sill by welding. The center filler plate 22 includes the car body center plate 24. A sole plate 26 connects the body bolster 16 over the cast draft sill 10. The draft gear pocket of the cast draft sill has a pair of draft gear carrier members 28 mounted transversely thereto below the draft gear cushioning unit. The draft gear carrier members are connected to bottom flanges 30 of the draft sill. The end of the illustrated prior art cast draft sill includes a fish-tail plate 32 that has a generally U-shaped opening 34; the fish tail plate has a pair of facing horizontally disposed fillets that function to transmit and distribute forces from the cast draft sill to sides of the center sill 18 when the fillet plates and lip are welded to the railroad car center sill.

Figure 2:
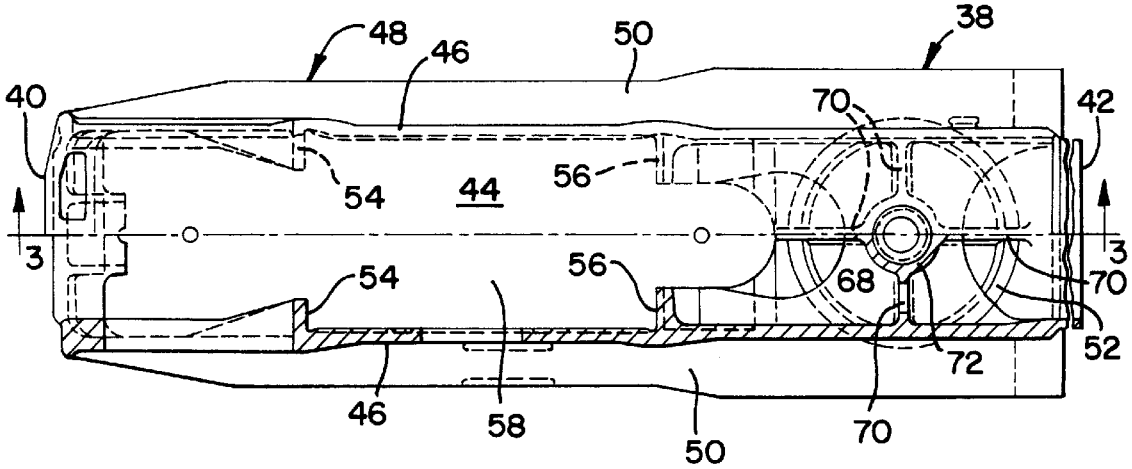
FIG. 2 PRIOR ART
FIG. 2 is a top plan view of a prior art cast draft sill, with the bottom half shown in cross-section.
Figure 3:
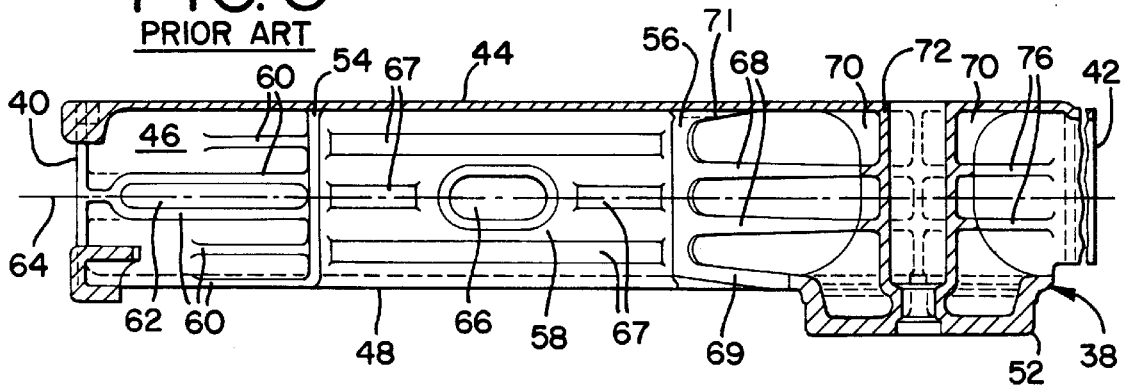
FIG. 3 PRIOR ART
FIG. 3 is a cross-section of the prior art draft sill of FIG. 2, taken along line 3—3 of FIG. 2.

A typical prior art cast draft sill structure is illustrated in FIGS. 2–3. The illustrated prior art cast draft sill 38 is the type sold by American Steel Foundries of Chicago, Ill. as a draft sill end casting and is different from the cast draft sill shown in FIG. 1. The draft sill 38 of FIG. 2–3 has a front end 40, a back end 42, a top wall 44 and a pair of parallel side walls 46 depending from the top wall between the front and back ends, and a bottom portion 48 including side flanges 50. The embodiment illustrated in FIGS. 2 and 3 has an integral center plate 52, although other designs, including a center filler plate design of the type shown in U.S. Pat. No. 4,252,068 (1981) to Nolan, have been used.

The prior art draft sill 38 has front and rear stops 54, 56, defining a pocket 58 between them. The front stop 54 in the illustrated prior art cast draft sill 38 has five ribs 60 extending toward the front end 40, two of which ribs define a key slot 62 in each side wall, with a theoretical force line 64 running through the key slot 62. All of the ribs 60 have surfaces substantially parallel to the top wall 44. In the pocket 58, there is a single lightener hole 66, centered on the theoretical force line 64, and surrounded by a follower guide pads 67. When a coupler shank is received in the draft sill, the longitudinal centerline of the coupler shank is generally along the theoretical force line 64.

Figure 10:
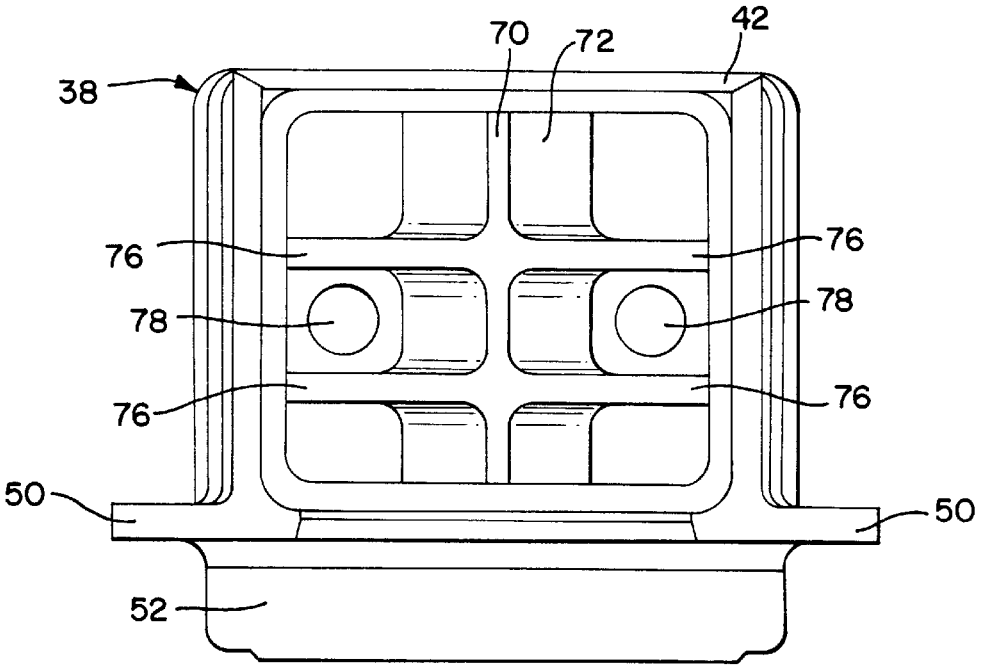
FIG. 10 PRIOR ART
FIG. 10 is an end view of the prior art draft sill of FIG. 2, taken from the back end of the cast draft sill.

From the rear stop 56, the prior art draft sill 38 has two horizontal ribs 68 that extend to connect with vertical ribs 70 and an open member 72 between the center plate 52 and the top wall 44. The two horizontal ribs 68 have surfaces that are parallel to the top wall 44, and are spaced from the top wall and the plane of the flanges 50. A short bottom rib 69 extends from the rear stop near the flanges 50. A short top rib 71 extends from the rear stop toward the back wall. Back portions 76 of the ribs 68 at the same level as the remainder of the ribs extend from the open member 72 and vertical side ribs 70 back toward the back end 42 of the draft sill 38. A circular lightener hole 78 is between the two ribs 76 in each of two of the vertical ribs 70, as shown in FIG. 10.

An embodiment of the draft sill 100 of the present invention is shown in FIGS. 4–9 and 11, and other embodiments are shown in FIGS. 13–14 and 16–18. In all these embodiments, the same reference numbers have been used for like parts.

Figure 4:
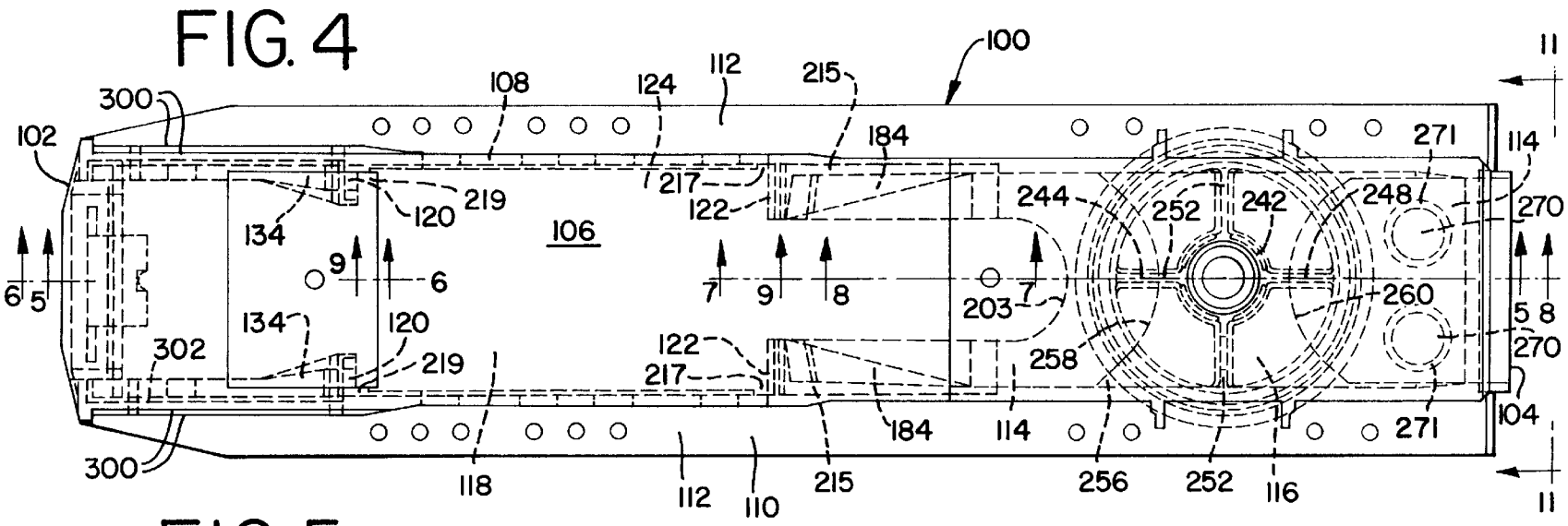
FIG. 4 is a top plan view of an embodiment of the cast draft sill of the present invention.
Figure 5:
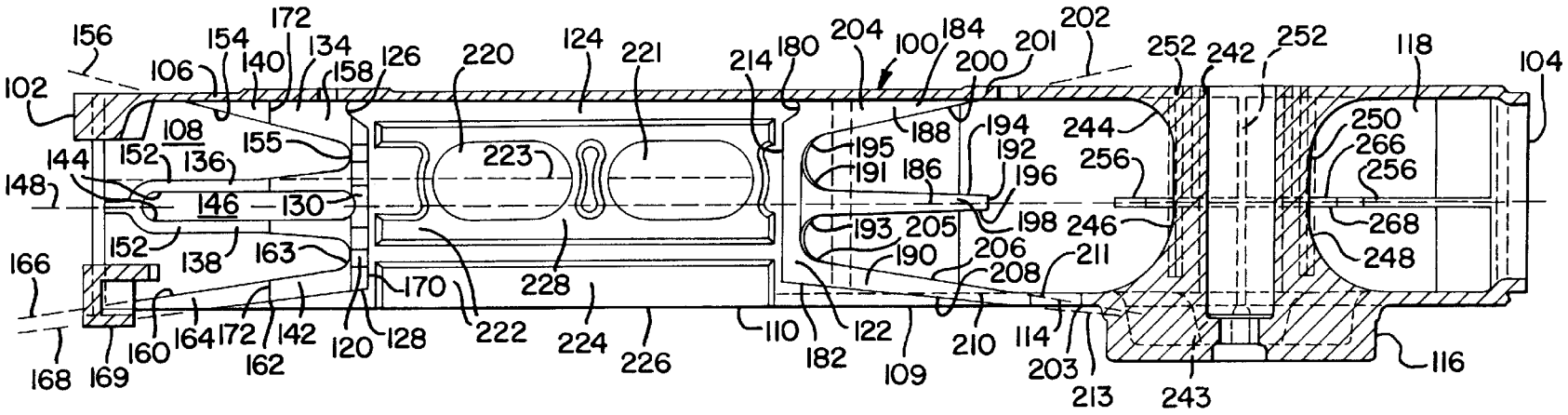
FIG. 5 is a cross-section of an embodiment of the cast draft sill of the present invention, taken along line 5—5 of FIG. 4, for use with a standard type E coupler.
Figure 6:
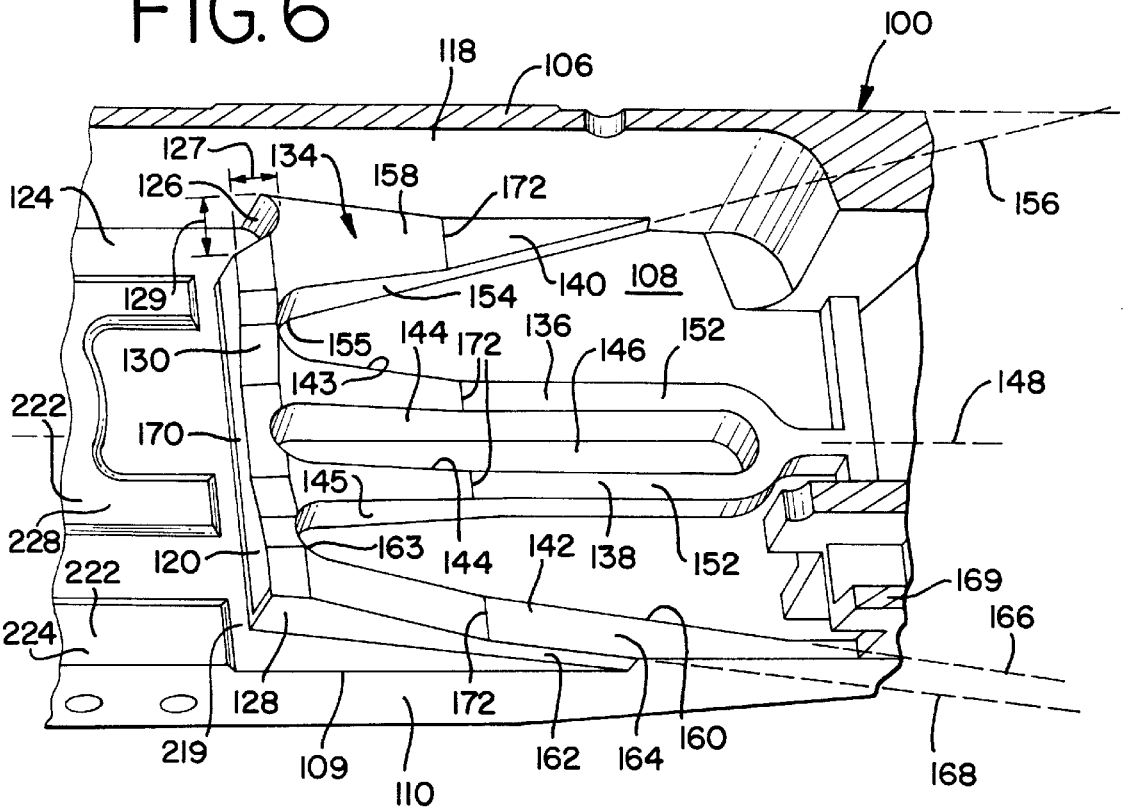
FIG. 6 is a cross-section, shown in perspective, of the front stop and front rib set of the embodiment of FIG. 4, taken along line 6—6 of FIG. 4.
Figure 12:
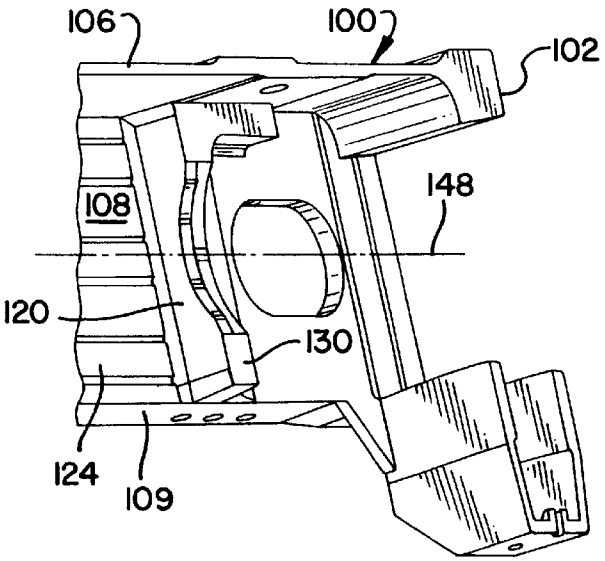
FIG. 12 PRIOR ART
FIG. 12 is a cross-section, shown in perspective, of an alternative front stop and front rib set, that may be used with a standard type F coupler.

The first illustrated end sill casting of the present invention, shown in FIGS. 4–6 is for an E-type coupler. It should be understood that several of the features of the present invention apply as well to F-type couplers as well. The features, such as the rear rib set 184, lightener openings 220, 221, stop recesses 126, 180, openings 254 in the side vertical center plate ribs 252, bottom wall vent holes 270, horizontal center plate rib 256, and open space between the horizontal center plate rib 256 and rear rib set 184, for example, may be combined with a standard set of front ribs for an F-type coupler, such as shown in FIG. 12.

As shown in FIG. 4, the first illustrated cast draft sill 100 has a front end 102, a back end 104, a top wall 106 and a pair of parallel side walls 108 depending from the top wall 106 between the front and back ends 102, 104. The illustrated side walls 108 have bottoms 109 opposite the top wall 106. At the bottoms 109, the draft sill also has a bottom portion 110 comprising a pair of side flanges 112 extending outward from the side walls 108 opposite the top wall 106 and a bottom wall 114 extending inward from the side walls 108 at the back end 104 of the draft sill. An integral center plate 116 depends from the bottom wall 114. The center plate 116 may be of any type and size known in the art.

The interior 118 of the draft sill 100 is defined by the side walls 108 and top wall 106. As shown in FIGS. 4–9 and 16–18, there are opposed front stops 120 on the interior sides of the side walls 108, each front stop 120 extending from the side wall 108 toward one another. There are opposed rear stops 122 on the interior sides of the side walls 108, each rear stop 122 extending from the side wall 108 toward one another. In the front portion of the draft sill, the interior 118 is accessible from beneath, since there is no bottom wall between the rear stop 122 and the front end, but only the outwardly extending flanges 112.

As shown in FIGS. 4–9 and 16–18, the front and rear stops 120, 122 are spaced apart and there is a pocket 124 between them. The pocket 124 is a space that may receive a shock-absorbing device, such as a draft gear, for use in conjunction with a coupler received through the front end of the draft sill. The illustrated draft sills may also be used with other conventional systems for connecting railroad cars together, such as a drawbar assembly or other non-coupler type connecting device instead of a coupler, in which case the pocket may be filled with some other structure.

Figure 9:
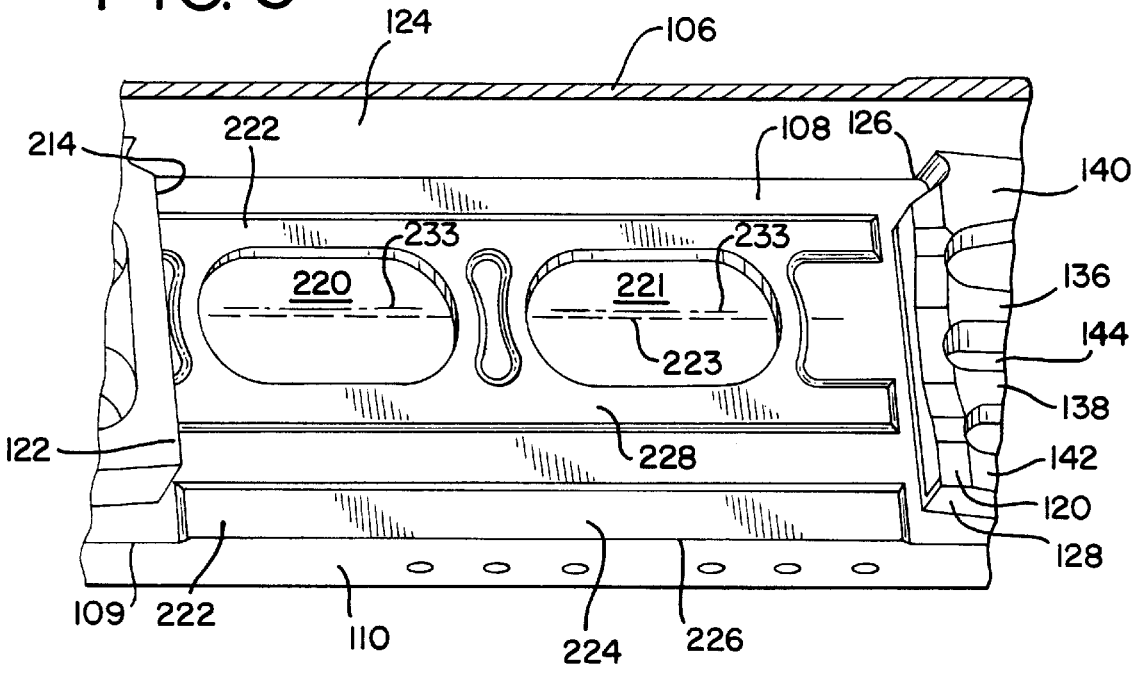
FIG. 9 is a cross-section, shown in perspective, of the pocket of the draft sill of the embodiment of FIG. 4, taken along line 9—9 of FIG. 4.

As shown in FIGS. 5, 6, and 9, near the top wall 106, there is a deep recess 126 separating the front stop 120 from the top wall 106. The illustrated deep recess 126 comprises a radius connected to the front stop 120 by a short angled segment that is tangent to the radius and shaped to blend into the front stop 120. However, it should be understood that other shapes may be used. The illustrated front deep recess 126 has a length of about 1.37 inches from the plane of the stop face 170 of the front stop 120 toward the front end 102, shown as dimension 127 in FIG. 6; the illustrated recess also has a height, shown as dimension 129 in FIG. 6, of about 1.69 inches, that is, the top end of the stop face 170 is about 1.69 inches from the interior side of the top wall 106; the illustrated front deep recess 126 exceeds a minimum of about one-half inch high and about one-half inch deep; it should be understood that these dimensions are given for purposes of illustration only. The use of the front deep recess 126 should allow for some weight reduction and facilitate finishing in this area of the casting. As shown in FIGS. 5, 6 and 9, the bottom end 128 of the front stop 120 may be spaced above the flange 112. As described below, the bottom end 128 of the front stop 120 illustrated in FIGS. 5, 6 and 9 is angled downward toward the flange 112 at the bottom 109 of the side wall and toward the front end 102 of the draft sill 100 to match the angle of the bottom surface of the bottom front rib 142. The deep recess 126 and spacing and angling of the ends of the front stop from the top and bottom of the casting is expected to relieve potential stress concentrations in those areas and to avoid edge loading in those areas; instead, any load should travel through the front rib set 134. The use of the deep recesses 126 should limit the formation of stress risers and should limit interference with the draft gears in the pocket.

The structures of both sides of the illustrated draft sills along the longitudinal centerline are generally the same, that is, they are mirror images of one another, and a single side will be described. It should be understood that the description of the front stop 120 and front rib set 134 apply to the opposing front stop 120 and front rib set 134 as well.

As illustrated in FIG. 6, the inward-facing surface 130 of the front stop 120 is dished at its center. In other words, the center of the surface of the front stop illustrated in FIGS. 5, 6 and 9 has a depression extending towards the side wall 108 from which the front stop extends. It should be understood that the front stop may be made with top surfaces with different shapes, such as a level surface. By providing the dished top surface, the illustrated cast draft sill may be used with both standard coupler assemblies as well as with non-coupler connecting devices, such as drawbars.

Although the embodiment of the invention illustrated in FIGS. 4–6 utilizes the front stop 120 of the present invention with other features of the invention, it should be understood that the illustrated front stop may be used with or without the other features of the invention, as well as with some or all of the other features of the invention. In addition, other features of the invention may be used with or without the front stop of FIGS. 4-6. For example, other features of the invention may be used with a prior art front stop of the type shown in FIG. 12.

Figure 17:
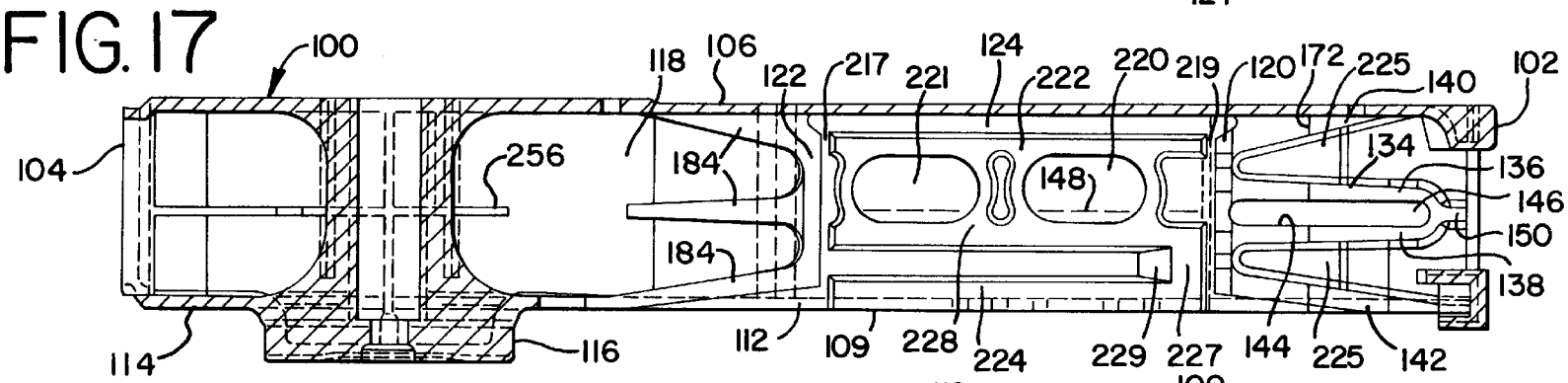
FIG. 17 is a cross section of the embodiment of FIG. 17, taken along line 17—17 of FIG. 16.

The illustrated front rib set 134 is associated with one front stop 120. The front rib set 134 functions to distribute forces acting on the front stop 120 to the side walls 108, top wall 106, and to some extent, to the flanges 112. As shown in FIGS. 5, 6 and 17, each front rib set 134 includes top and bottom key slot ribs 136, 138, a top rib 140 and a bottom rib 142. The top and bottom key slot ribs 136, 138 extend from the front stop 120 toward the front end 102 of the draft sill 100. The top and bottom key slot ribs 136, 138 have spaced, substantially parallel surfaces 144 separated by a key slot 146 in the side wall. A mirror image front rib set is on the opposite side wall, and only one front rib set will be described; it should be understood that this description applies as well to the opposite front rib set.

Figure 13:
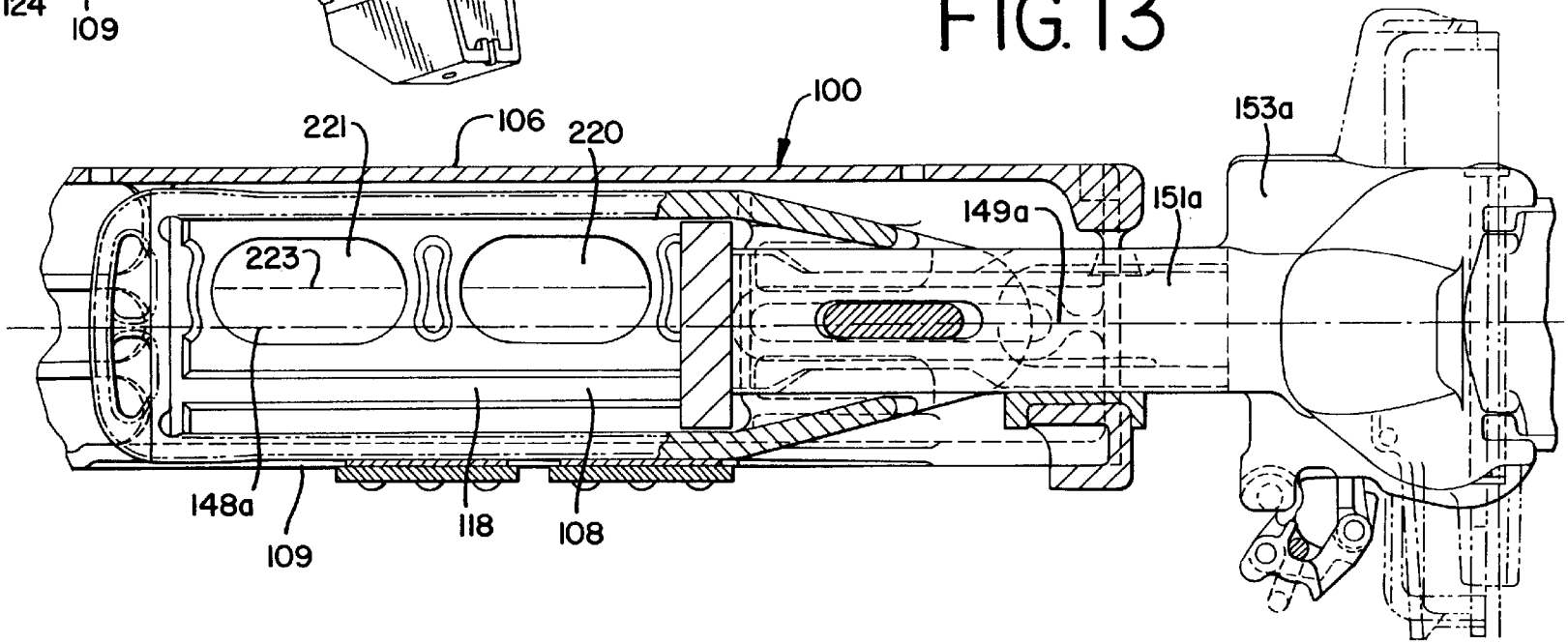
FIG. 13 is a cross-section of a draft sill with a standard type-E coupler received in the draft sill, showing the design position of the longitudinal centerline of the shank of the coupler corresponding with the theoretical force line. The embodiment of FIG. 13 uses the lightener holes of the present invention but not other features of the invention.
Figure 14:
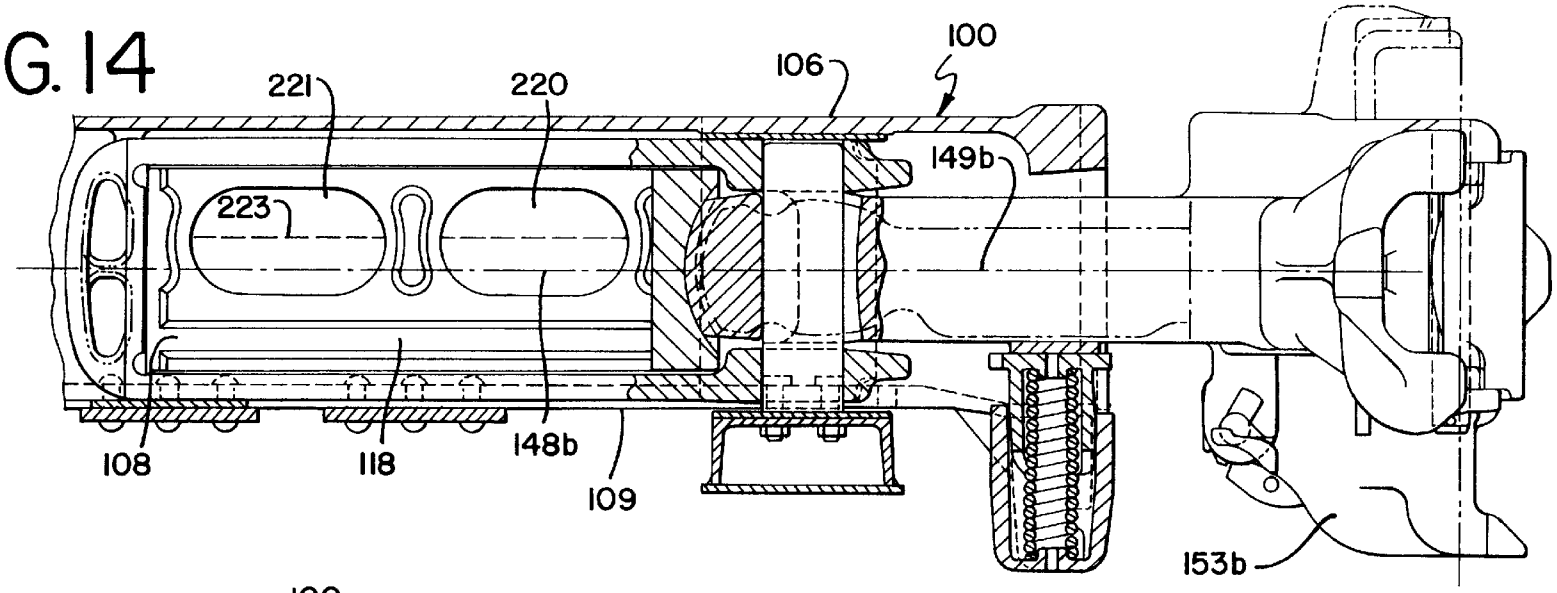
FIG. 14 is a cross-section of a draft sill with a standard type-F coupler received in the draft sill, showing the design position of the longitudinal centerline of the shank of the coupler corresponding with the theoretical force line. The embodiment of FIG. 14 uses the lightener holes of the present invention but not other features of the invention.
Figure 15:
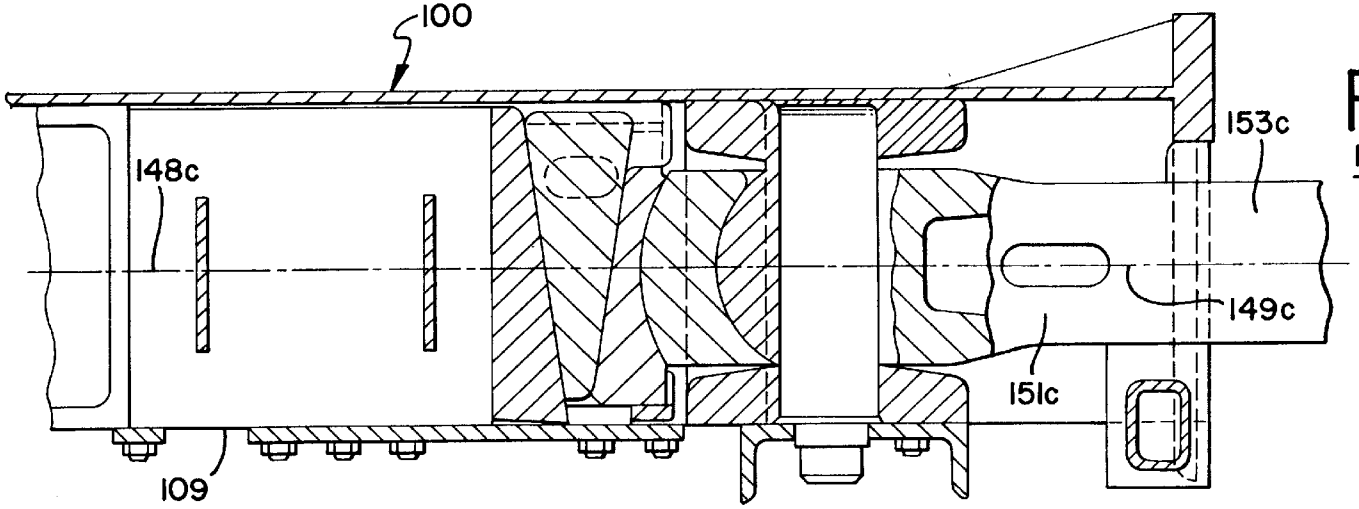
FIG. 15 PRIOR ART
FIG. 15 is a cross-section of a prior art draft sill with a drawbar received in the draft sill, showing the design position of the longitudinal centerline of the shank of the drawbar corresponding with the theoretical force line.

The draft sill illustrated in FIGS. 5, 6 and 17 is of the type designed for use with a standard E-type coupler. The two opposing key slots 146 in the side walls have co-planar central axes that are parallel with the top wall 106 and correspond with a theoretical force line 148; the theoretical force line for the draft sill for use with the E-type coupler is shown in FIG. 5 as reference number 148 and in FIG. 13 as reference number 148*a*. For any connecting device, the theoretical force line 148 is the line along which buff and draft forces are expected to be transmitted from the shank 151 or butt end to the structures within the draft sill and to the draft sill itself. As shown in FIGS. 5, 6 and 13, for the draft sill 100 designed to receive an E-type coupler for connecting one railroad car to another, the theoretical force line 148*a* is generally parallel with the top wall 106 and side walls 108. FIG. 13 shows the design position for the shank 151*a* of the coupler 153; as shown in FIG. 13, the theoretical force line 148*a* generally corresponds with the design position for the longitudinal centerline 149*a* of the shank 151*a* of the coupler 153*a*. As shown in FIGS. 14 and 15, the theoretical force line 148 corresponds with a design position for a longitudinal centerline 149 of the shank 151 of other types of connecting devices 153 as well. As shown in FIG. 14 when a standard F-type coupler 153, which has no horizontal key slot, is received in the interior 118 of the draft sill 100, the theoretical force line 148*b* also generally corresponds with a design position of a central longitudinal axis 149*b* of the coupler shank 151*b* of the coupler 153*b*. For a drawbar arrangement or any other connecting device, as shown in FIG. 15, the theoretical force line 148*c* will correspond with the central longitudinal axis 149*c* of the shank 151*c* or butt end of the connecting device 153*c* when received in the interior 118 of the draft sill. As used herein, "shank" is intended to refer to the shank, butt end, or force-transferring end of the connecting device to be received in the draft sill, and "connecting device" is not limited to any particular coupler or drawbar, but includes all standard couplers, drawbars, and any device that is used to connect adjacent railroad cars together. Other car connections or connecting systems that may be used with the present invention include, for example: SBE couplers, both E and E/F; SE couplers, both E and E/F; Rotary Dump couplers; SF couplers; articulated connectors; and yokes usable with such systems. As seen from FIGS. 13–15, the positions of the theoretical force lines 148 and design positions for the longitudinal centerlines 149 are generally the same in the present invention as in the prior art.

As shown in FIGS. 5 and 6, at the forward end of each key slot 146, the top and bottom key slot ribs 136, 138 join into a single rib 150 that extends to the front end 102 of the draft sill. As shown, the ends of the key slot ribs 136, 138 near the back end of the key slot 146 are curved to join with the front stop 120, and the top and bottom surfaces 143, 145 of the key slot ribs 136, 138 diverge outwardly toward the front stop 120. The inward-facing surfaces 152 of the top and bottom key slot ribs 136, 138 also taper down toward the side wall 108 from high points at the juncture with the front stop 120.

As shown in FIGS. 5 and 6, the front top rib 140 extends from the front stop 120 toward the front end 102 and to the top wall 106 and to the side wall 108. The top rib 140 has a lower surface 154 that joins the front stop 120 at a position spaced from the top wall 106. The lower surface 154 and the front stop 120 are joined along a curved surface 155 that also joins the front stop 120 to the top key slot rib 136. As shown in FIGS. 5 and 6, the front top rib 140 is shaped so that a plane 156 parallel with a length of the top rib bottom surface 154 defines an acute angle with the plane of the top wall 106. The top rib 140 is the only rib between the top key slot rib 136 and the top wall 106 of the draft sill. The inward-facing surface 158 of the top rib 140 tapers down toward the side wall 108 from a high point at the juncture with the front stop 120. The deep recess 126 separates a part of the front top rib 140 from the top wall 106.

As shown in FIGS. 5 and 6, the front bottom rib 142 extends from the front stop 120 toward the front end 102 of the draft sill and toward the bottom 109 of the side walls 108 or bottom portion 110 of the draft sill. The front bottom rib 142 also extends to and along the side wall 108. The front bottom rib 142 has a top, bottom and inward-facing surfaces 160, 162, 164. The top and bottom surfaces 160, 162 are shaped so that a plane 166 parallel with a length of the bottom rib top surface 160 and a plane 168 parallel with a length of the front bottom rib bottom surface 162 define acute angles with the plane of the bottoms 109 of the side walls 108, although not necessarily the same angle need be defined by the planes 166, 168, parallel with the two surfaces 160, 162. The front bottom rib 142 is the only rib between the bottom key slot rib 138 and the bottom portion 110 of the draft sill. The front bottom rib top surface 160 joins the front stop 120 along a curved surface 163 that also joins the bottom key slot rib 138 to the front stop 120. The front bottom rib bottom surface 162 meets the front stop 120 at a position spaced from the plane of the bottoms 109 of the side walls 108.

In the embodiment illustrated in FIGS. 5–6, the front bottom rib top and bottom surfaces 160, 162 are parallel, and are spaced apart a constant distance of about 1.38 inches, the bottom surface 162 meeting the bottom 109 of the side wall 108 at a distance of about 9.88 inches from the stop face 170 of the front stop, and the top surface 160 meeting or merging into the transverse carrier rib 169 of the striker carrier at a distance of about 14.25 inches from the stop face 170 of the front stop 120. The transverse carrier rib 169 extends across the width of the draft sill so that forces from the front stop 120 may be transmitted through the bottom rib 142 to the transverse carrier rib 169. In the embodiment illustrated in FIG. 17, like numbers have been used for the draft sill parts. In the FIG. 17 embodiment, the front bottom rib top and bottom surfaces 160, 162 are spaced apart a distance of about 1.50 inches, with the bottom surface 162 meeting the bottom 109 of the side wall 108 at a distance of about 9.63 inches from the stop face 170 of the front stop 120. The top and bottom key slot ribs 136, 138 shown in FIG. 5 have a maximum thickness of about 1.25 inches near the front stop 120, and the thickness of each rib tapers to the point where the top and bottom surfaces 143, 145 become parallel to the surfaces 144, at a distance of about 7 inches from the stop face 170; the depth of each key slot rib 136, 138 tapers from the top surface 130 of the front stop 120 toward a line 172 along which all of the front ribs 136, 138 140, 142 flatten to a common depth or distance from the side wall 108 inner surface. Alternatively, as shown in FIG. 17, the thicknesses of the key slot ribs 136, 138 may taper about 0.50 inches over a distance of 11 inches from the stop face 170. In either embodiment, the illustrated front top rib 140 may have a length of about 11.5 inches from the stop face 170 of the front stop to the juncture of the top rib and the top wall, and tapers from a maximum thickness of about 2.75 inches near the juncture with the front stop to meet the top wall. It should be understood that the front rib set 134 dimensions and other dimensions are given for purposes of illustration only and that other dimensions may be used. For example, if a draft sill with a different overall length is made, the dimensions for the lengths of the ribs will probably change.

Although the illustrated embodiment utilizes the front rib set 134 in combination with other features of the present invention, it should be understood that the front rib set of the present invention may be used with or without the other features of the invention, as well as with some or all of the other features of the invention. In addition, other features of the present invention may be used with or without the illustrated front rib set 134. For example, other features of the invention may be used with a draft sill designed to receive an F-style or other style coupler or connecting device, such as shown in FIG. 12, in which case there would be no key slot and other types of front ribs may be used.

Figure 7:
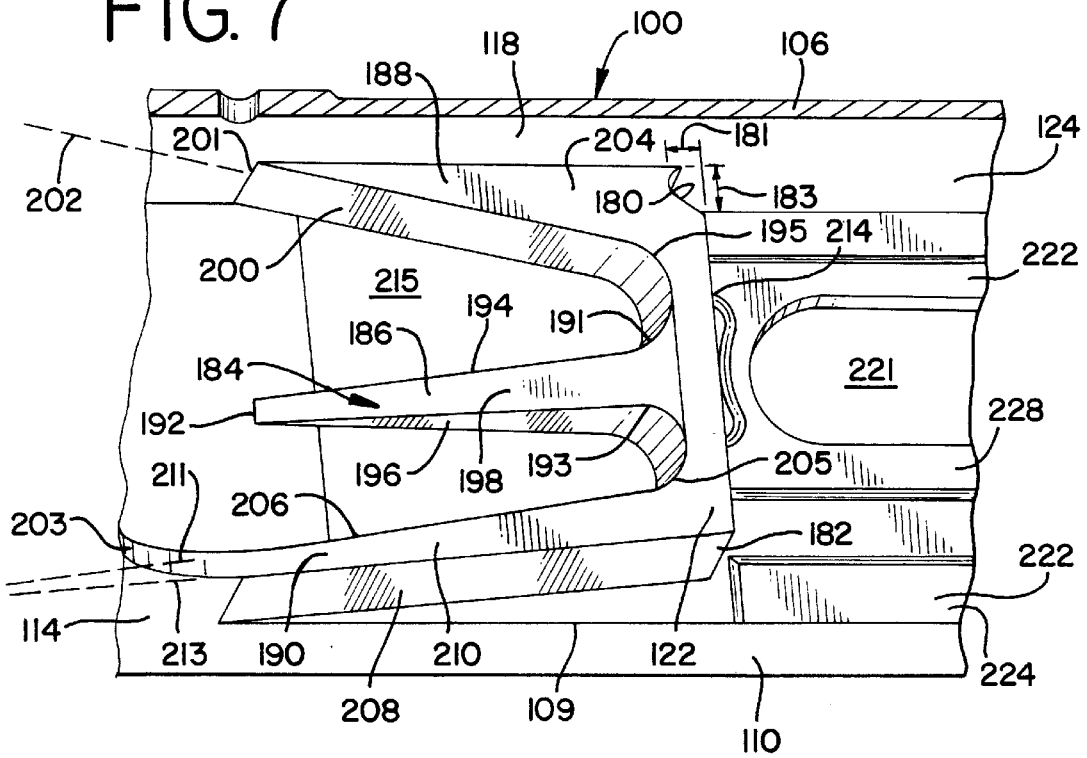
FIG. 7 is a cross-section, shown in perspective, of the rear stop and back rib set of the embodiment of FIG. 4, taken along line 7—7 of FIG. 4.

Representative rear stops 122 of the present invention are illustrated in FIGS. 4, 5 and 7. There are opposed rear stops 122 on the interior side of each side wall 108, each extending from the side wall inward toward one another. Near the top wall 106, there is a back deep recess 180 separating the rear stop 122 from the top wall 106. As with the front deep recess 126 of the front stop 120, the back deep recess 180 comprises a radius connected to the rear stop 122 by a short angled segment, although other shapes may be used. The use of the back deep recess 180 should allow for some weight reduction and facilitate finishing in this area of the casting. The bottom end 182 of the rear stop 122 is spaced above the bottom portion 110 along the bottom of the side wall 108. As described below, the bottom end 182 of the rear stop 122 is angled downward toward the bottom 109 of the side wall 108 and toward the back end 104 of the draft sill to match the angle of the bottom surface 208 of the rear bottom rib 190. The deep recess 180 and spacing and angling of the ends 182 of the rear stop from the top 106 and bottom 109 of the casting is expected to relieve potential stress concentrations in those areas and to avoid edge loading in those areas; instead, load should travel through the back rib set 184. The use of the deep recesses 180 should limit the formation of stress risers and should limit interference with the draft gears in the pocket. The illustrated back deep recess 180 has a length of about 0.95 inches from the plane of the stop face 214 of the rear stop 122 toward the back end 104, shown as dimension 181 in FIG. 7; the illustrated recess also has a height, shown as dimension 183 in FIG. 7, of about 1.44 inches, that is, the top end of the stop face 214 is about 1.44 inches from the interior side of the top wall 106; the illustrated back deep recess 180 exceeds a minimum of about one-half inch high and about one-half inch deep; it should be understood that these dimensions are given for purposes of illustration only. The embodiment illustrated in FIGS. 4, 5 and 7 also includes a rear rib set 184 associated with each rear stop 122.

Although the embodiment of the invention illustrated in FIGS. 4–5 and 7 utilizes the rear stop 122 of the present invention with other features of the invention, it should be understood that the illustrated rear stop may be used with or without the other features of the invention, as well as with some or all of the other features of the invention. In addition, other features of the invention may be used with or without the rear stop of FIGS. 4–5 and 7. For example, other features of the invention may be used with a prior art rear stop and rear rib set as shown in FIG. 13.

As discussed above, the structures of both sides of the draft sill along the longitudinal centerline are generally the same, that is, they are mirror images of one another, and a single side is described. It should be understood that the description of the rear stop 122 and rear rib set 184 apply to the opposing rear stop 122 and rear rib set 184 as well.

As shown in FIGS. 5 and 7, the illustrated rear rib set 184 includes a rear central rib 186, a rear top rib 188 and a rear bottom rib 190, all extending from the rear stop 122 toward the back end 104 of the draft sill 100. Each illustrated rear central rib 186 extends from the rear stop 122 toward the back end 104 of the sill and joins the rear stop 122 to the side wall 108. As shown in FIG. 7, each rear central rib 186 has a back end 192 opposite top and bottom curved junctions 191, 193 with the rear stop 122, and top, bottom and inward-facing surfaces 194, 196, 198. The top and bottom surfaces 194, 196 of the illustrated rear central rib 186 taper toward each other between the rear stop 122 and the rib back end 192. The rear central rib 186 is generally centered in the plane of the theoretical force line 148, between the top wall 106 and flanges 112 of the draft sill. The inward-facing surface 198 of each rear central rib 186 tapers toward the associated side wall 108 so that each rib back end 192 blends smoothly into the associated side wall 108.

As shown in FIGS. 5 and 7, the rear top rib 188 of each illustrated rear rib set 184 extends from the rear stop 122 toward the back end 104 and toward the top wall 106 and joins the rear stop 122 with the side wall 108 and top wall 106. There is a curved junction 195 between the rear top rib 188 and the rear stop 122, the curved junction 195 curving into the top curved junction 191 of the rear central rib 186 and the rear stop. The curved junctions 195, 191 widen toward the side wall 108. The rear top rib 188 has a bottom surface 200 shaped so that a plane 202 parallel with a length of the bottom surface 200 defines an acute angle with the plane of the top wall 106. The illustrated rear top rib 188 has a back end 201 at the junction of the top rib and the top wall 106. The illustrated rear top rib 188 has a substantially constant depth or thickness between the rear stop and the top wall, that is, the inward-facing surface 204 of the rear top rib is generally parallel to the inward-facing surface of the side wall 108. As with the front top rib 140, the deep recess 180 separates a part of the rear top rib 188 from the top wall 106. The rear top rib 188 is the only rib between the rear central rib 186 and the top wall 106.

The rear bottom rib 190 illustrated in FIGS. 5 and 7 extends from the rear stop 122 toward the bottom 109 of the draft sill side wall 108 and toward the back end 104 of the draft sill. The rear bottom rib 190 is connected to the side wall 108, and joins the bottom wall 114 at its rearward end, at a position close to the radius 203 of the bottom wall 114. The rear bottom rib 190 has a curved juncture 205 with the rear stop 122 that meets the bottom curved juncture 193 of the rear central rib 186 and thickens toward the side wall. The rear bottom rib 190 has top, bottom and inward-facing surfaces 206, 208, 210. The rear bottom rib 190 is shaped so that a plane 211 parallel with a length of the top surface 206 defines an acute angle with the plane of the bottom 109 of the side wall 108 and a plane 213 parallel with a length of the bottom surface 208 defines an acute angle with the plane of the bottom 109 of the side wall 108. The bottom rib 190 is the only rib between the rear central rib 186 and the plane of the bottoms 109 of the side wall 108. The inward facing surface 210 of the rear bottom rib 186 is generally parallel with the inward-facing surface of the side wall 108 so that the rear bottom rib 186 has a substantially constant width throughout its length. The illustrated rear bottom rib 190 tapers so that its thickness between its top and bottom surfaces 206, 208 matches the thickness of the side flange 112 and bottom wall 114 at the juncture with the bottom 109 of the side wall 108.

Figure 16:
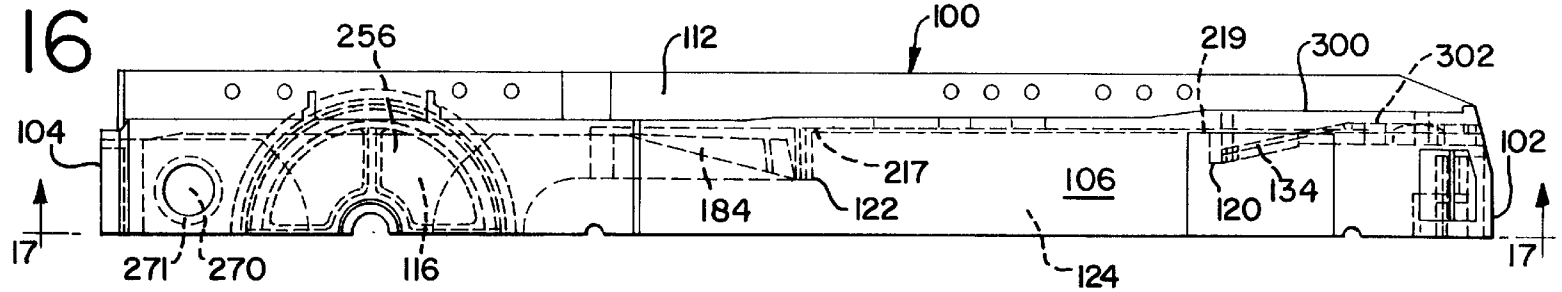
FIG. 16 is a half top plan view of an alternate embodiment of the draft sill of the present invention.
Figure 18:
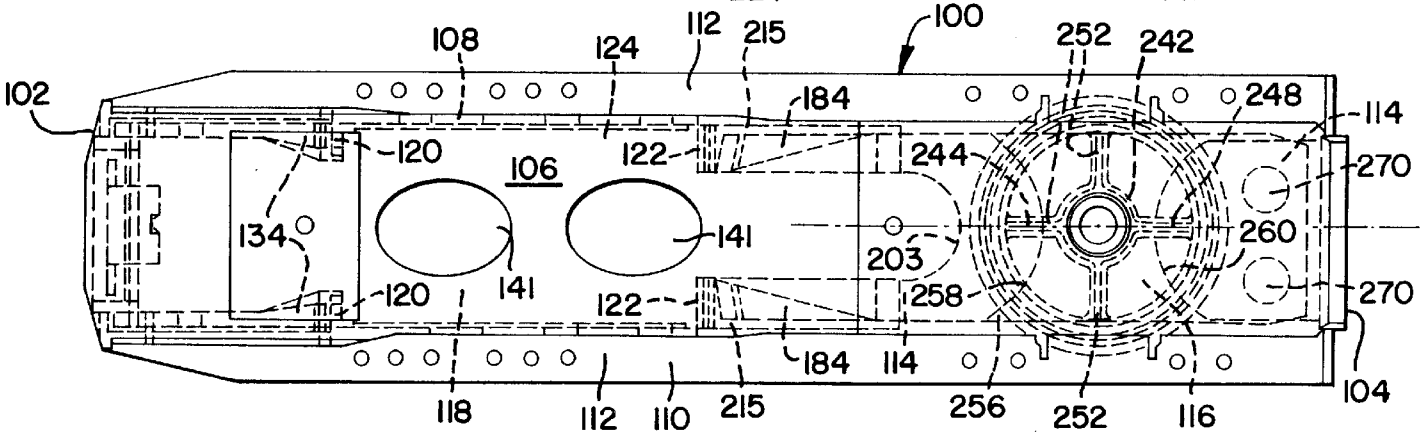
FIG. 18 is a top plan view of an alternative embodiment of the draft sill of the present invention.

Substantially similar rear rib sets 184 and rear stops 122 are used in the embodiments of FIGS. 16–18. It should be understood that the rear rib set 184 may be used with none, some or all of the other features of the invention, and that other features of the invention may be used with or without using the rear rib set 184.

In the FIG. 7 embodiment, the rear central rib 186 has a thickness between its top and bottom surfaces 194, 196 of about 0.75 inches at the back end 201 and about 1.63 inches before the curves at the junctions 191, 193. The lengths of the illustrated rear top 188 and central 186 ribs, from the stop face 214 of the rear stop 122 to the ends 192, 201 are both about 12.50 inches, and the rear bottom rib 190 reaches the level of the plane of the flanges 112 at about 14 inches from the stop face 214 of the rear stop 122, as near as possible to the radius 203 of the bottom wall 114. The thickness of the illustrated rear bottom rib 190 near the curved juncture 205 is about 1.50 inches, tapering down to the thickness of the bottom wall, about 0.75 inches at the juncture with the bottom wall 114, about the thickness of the side flanges 112. The illustrated rear top rib 188 has a thickness of about 2.50 inches near the curved juncture 195, tapering to the end 201. It should be understood that these dimensions are given for purposes of illustration only, and the invention is not limited to these or any other dimensions set out in this description.

As shown in FIG. 4, the side walls 108 of the illustrated draft sill 100 may have thickened regions 215 between the rear stop 122 and the back end 104 of the draft sill, between the top surface 206 of the rear bottom rib 190 and the top wall 106, with the inward-facing surfaces of the back portion of the side walls 108 being set in by about one-quarter inch. This added thickness to the sidewalls is in the area adjacent the rear throat area 217, that is, the area between the rear stop 122 and the pocket ribs or follower guide pads 222. The thickened regions 215 should stiffen the structure sufficiently to alleviate bending stresses at the rear throat 217. A similar thickened region may be added to the area of the sidewalls 108 between the front stop 120 and the front end 102 of the draft sill to alleviate bending stresses at the front throat 219, that is, the side wall area between the front stop 120 and the pocket ribs or follower guide pads 222. FIG. 17 illustrates such a thickened region 225 of the sidewall forward of the front stop 120. En the embodiment illustrated in FIG. 17, the thickened region 225 has a thickness of about one and one-half inches and a length of about 7 inches, and tapers to the typical sidewall thickness.

The pocket 124 between the front and rear stops 120, 122 may also contain some unique features that contribute to the lower weight and other advantages achieved by the present invention. As shown in FIGS. 5, 9, 13–14 and 17, each sidewall 108 of the pocket 124 may include front and back lightener holes 220, 221 surrounded by follower guide pads or pocket ribs 222.

As shown in FIG. 9, the illustrated follower guide pads or pocket ribs 222 include a rectangular bottom rib or portion 224 extending from the bottom 109 of the side wall 108 up toward the top wall 108, along the substantial length of the pocket 124. Above the rectangular portion 224 is a middle rib or portion 228 surrounding and spacing the lightener holes 220, 221 apart. The illustrated follower guide pads extend inwardly from the inward face of the side walls, providing an area of reduced dimension for receipt of the draft gear or other structure. The follower guide pads 222 generally correspond with a thickening of the side walls. It should be understood that the shapes of the follower guide pads 222 are given for purposes of illustration only, and that other shapes may be used. For example, as shown in the embodiment of FIG. 17, it may be desirable to tie the bottom pocket rib 224 and middle pocket rib 228 with a bridge 227 and taper 229 to strengthen the area of the throat 219.

The sides of the pocket 124 along the longitudinal centerline are generally mirror images of one another. A single side of the pocket is described, although it should be understood that the description of the pocket ribs 222 and lightener holes 220, 221 applies to the other side as well.

The illustrated forward lightener hole 220 has a length of about 8.25 inches, a height of about 4.50 inches, and is spaced from the stop face 170 of the front stop 120 by a distance of about 4.00 inches to the forward end 230 of the front lightener hole 220. Thus, the illustrated front lightener hole 220 has an open area of about 32.78 square inches. The rear lightener hole 221 has a length of about 8.50 inches and a height of about 4.50 inches, an open area of about 33.90 square inches, with a spacing of about 1.75 inches from the point nearest the stop face 214 of the rear stop 122. The two lightener holes 220, 221 have a total open area of about 66.68 square inches and a common centerline 223 spaced about 4.75 inches from the inward-facing surface of the top wall 106. In contrast, the theoretical force line 148 is about 7 inches from the top wall 106. It should be understood that the particular dimensions, shapes, positions and areas of the lightener holes are given for purposes of illustration only, and that the invention is not limited to the illustrated embodiment.

In contrast, in the prior art cast draft sill, a single lightener hole 66 was provided with its centerline aligned with the central plane of the key slots, along the theoretical force line 64 illustrated in FIG. 3. Its length was approximately 7 inches, and its height about 3 inches, yielding an open area of about 19.09 square inches. In addition, the prior art follower guide pads were symmetrical around the lightener hole, the lower rectangular follower guide pad being spaced above the bottom edge of the side wall.

Thus, considering both side walls 108, the prior art total open area in the sidewalls was about 38.18 square inches while the total open area in the two sidewalls of the illustrated pocket is about 133.36 square inches.

The sizing and placement of the lightener holes 220, 221 in the pocket of the present invention, along with the shape and position of the follower guide pads, function to reduce the moments exerted on the draft sill pocket area. By moving the lightener holes 220, 221 upward and extending the follower pad 222 downward, the neutral axis of the pocket area 124 is moved closer to the theoretical force line 148 of the draft sill. Coupler forces will tend to operate along a theoretical force line 148. To reduce moments, it is desirable to reduce the moment arm, which in the case of draft sills of this type is the distance between the force line and the neutral axis. With the neutral axis being nearer the theoretical force line 148, the moment arm is shortened, decreasing the magnitude of the moments that would be exerted on the structure or walls defining the draft sill pocket 124. The differences in positions of the neutral axes may be shown through a comparison of the prior art structure of FIG. 3 and the embodiment of the present invention shown in FIGS. 5 and 9. Representative neutral axes may be calculated as the center of gravity for a cross-section through the pocket 124 at the part of the lightener holes having the greatest height; the location of the neutral axis or center of gravity or center of mass may be calculated using standard engineering equations. For the illustrated prior art draft sill structure, the neutral axis through the centers of the lightener holes 66 in both sidewalls is spaced about 0.60 inches above the theoretical force line 148. For the illustrated embodiment of the present invention, the neutral axis through the centers of the forward lightener holes 220 in both sidewalls is spaced 0.49 inches above the theoretical force line 148. Since it may be expected that the neutral axis nearest the force lines will be through the lightener holes, there should not be any neutral axis in the prior art or illustrated embodiment that more closely approaches the theoretical force lines 148. The positions of the neutral axes may be calculated using standard finite element analysis or 3-D modeling software, and one may determine that typical neutral axes are located at the position labeled 233 in FIG. 9 for the present invention. In general, as will be understood by those in the art, the neutral axis is determined as the center of gravity of the structure in a pre-determined plane through both side walls.

It should be understood that the sizes and shapes of the lightener holes 220, 221 and the position of the neutral axis are given for purposes of illustration only. It is not necessary that the lightener holes have the particular dimensions or shape or open area set forth, nor is it necessary that a neutral axis be positioned as illustrated.

It should also be apparent that the increased open area of the lightener holes 220, 221 of the present invention provides the advantage of producing a casting of lower weight than in the prior art, since there is less metal. For this purpose, as well as for the purposes of moving the neutral axis downward, it should be understood that the lightener holes could be shaped other than as shown in the drawings, and positioned other than as shown in the drawings. For example, one large lightener hole, or several lightener holes, could be provided in the top wall of the cast draft sill. Finite element analysis may be used to assure that the placement of the lightener holes does not adversely affect the strength of the structure. One example of such a draft sill is shown in FIG. 18, where a plurality of lightener holes 141 are in the top wall 106; such top wall lightener holes 141 may be combined with the sidewall lightener holes 220, 221, as well as with the other features of the invention; such top wall lightener holes 141 may be combined with the sidewall lightener holes 220, 221, as well as with the other features of the invention.

Although the illustrated embodiment utilizes the lightener holes 220, 221 in the pocket 124 in combination with other features of the invention, it should be understood that the lightener holes may be used alone, or in combination with some or all of the other features of the invention. For example, as shown in FIGS. 13–14, the lightener holes 220, 221 may be used with prior art stops and ribs.

Figure 8:
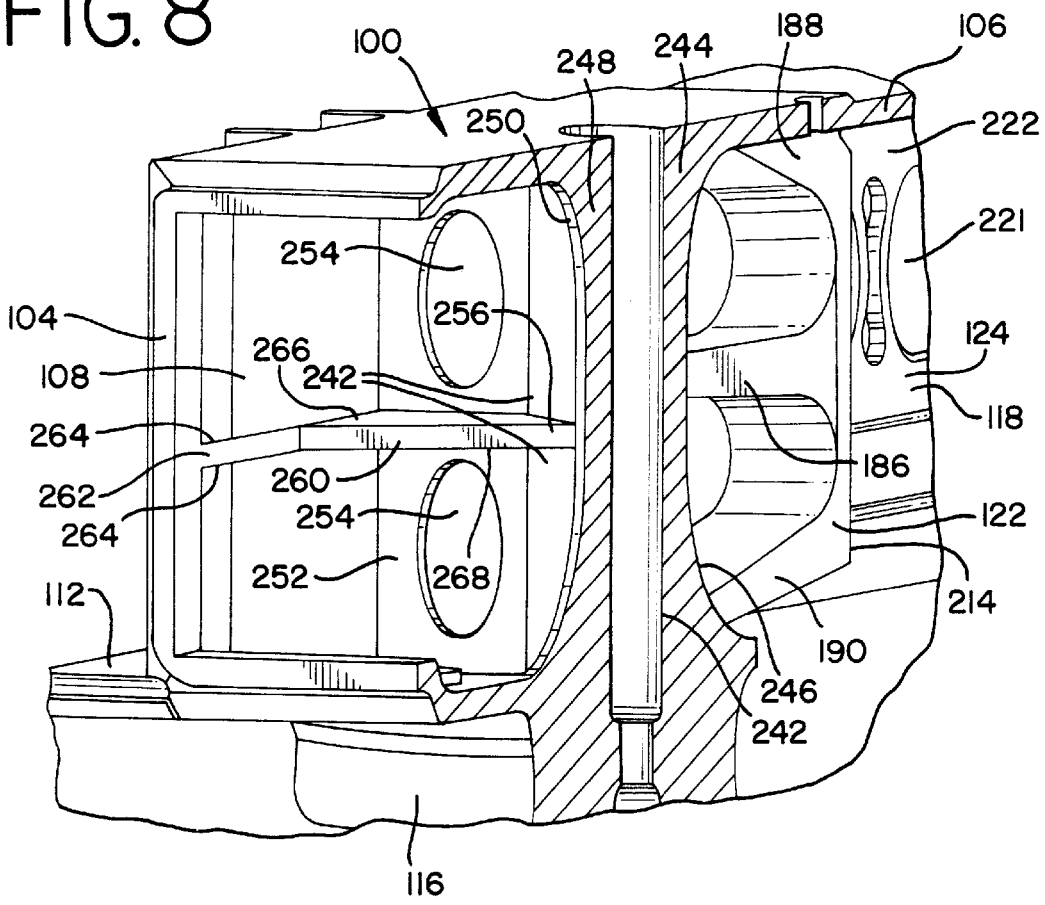
FIG. 8 is a cross-section, shown in perspective, of the ribs in the interior of the draft sill between the center plate and the top wall of the embodiment of FIG. 4, taken along line 8—8 of FIG. 4.
Figure 11:
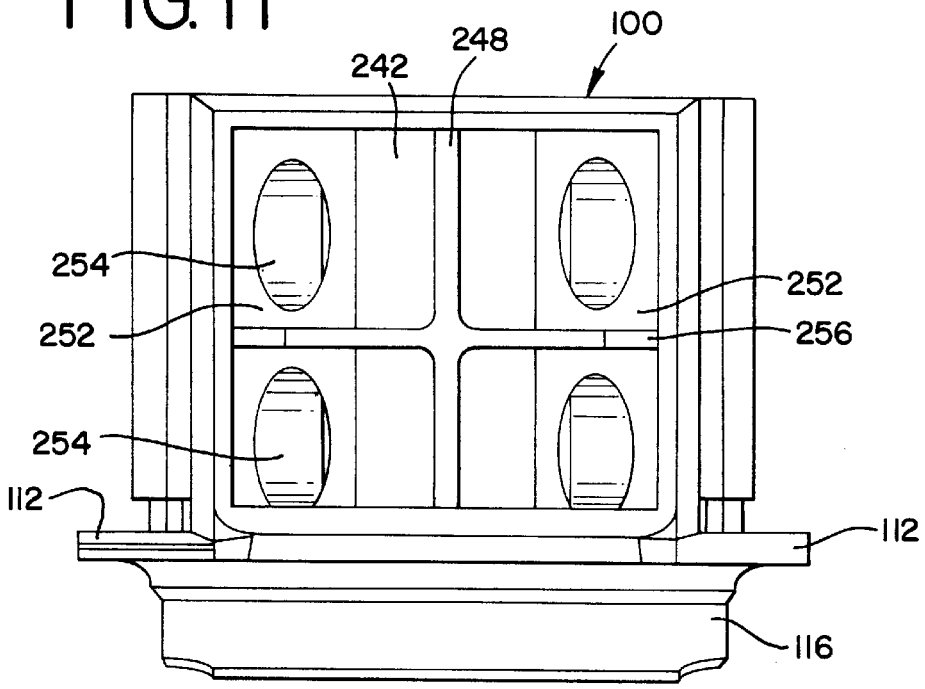
FIG. 11 is an end view of the cast draft sill of FIG. 4, taken from the back end of the cast draft sill along line 11—11.

The present invention also provides advantages in the structures supporting or reinforcing the center plate 116. As illustrated in FIGS. 4, 5, 8 and 17–18, the center plate 116 depends from the bottom wall 114 of the draft sill, between the front and back ends 102, 104 of the draft sill, and more particularly, between the back end 104 and a place rearward of the rear stop 122. As shown in FIGS. 5, 8 and 11, within the interior 118 of the draft sill, an upper open member 242 extends vertically from the top wall 106 of the draft sill toward the center plate 116. As shown in FIG. 5, a lower open member 243 connects the bottom of the upper open cylindrical member 242 and the interior side of the center plate. The lower open member 243 has a reduced diameter opening for holding a center pin. There is a hole in the center plate 116 so that a kingpin or center pin may be received through the lower open member 243 and extend through the upper open member 242 and center plate hole to connect the draft sill to a receiving center plate bowl on a railroad car truck bolster. As shown in FIGS. 4, 5 and 8, a front vertical rib 244 is connected to the upper and lower open members 242, 243 and extends from the center plate 116 to the top wall 106. As shown in FIGS. 5 and 8, the illustrated front vertical rib 244 has a front edge 246 that curves inward toward the upper open member 242 between the top wall 106 and the center plate 116. As shown in FIGS. 5, 8 and 18, a rear vertical rib 248 is connected to the upper and lower open members 242, 243 at a position diametrically opposed to the front vertical rib 244. The illustrated rear vertical rib 248 also extends from the top wall 106 to the center plate 116, and as shown in FIGS. 5 and 8 has a curved edge 250 that curves inward toward the upper open member 242 between the top wall 106 and the center plate 116. The curved edge 250 of the illustrated rear vertical rib 248 is between the upper and lower open members 242, 243 and the back end 104 of the draft sill. The curved edge 246 of the illustrated front vertical rib 244 is between the open member 242 and the rear stop 122. The illustrated front and back vertical ribs 244, 248 are co-planar and are positioned along the longitudinal centerline of the draft sill. The illustrated front and back vertical ribs 244, 248 are shaped the same, that is, the curvature of their edges 246, 250 is the same, but they curve in opposite directions.

As shown in FIGS. 4, 5, 8, 11 and 18, a pair of side vertical ribs 252 may also be connected to the upper and lower open members 242, 243 and may extend from the upper and lower open members 242, 243 to the side walls 108 and from the center plate 116 to the top wall 106. The illustrated side vertical ribs 252 are diametrically opposed to one another, and are perpendicular to the longitudinal axis of the draft sill. As shown in FIGS. 8 and 11, each illustrated side vertical rib 252 has a pair of vertically aligned and spaced oval lightener holes 254, with the major axis of each illustrated oval lightener hole 254 being vertically aligned.

The vertical ribs 244, 248, 252 need not be aligned as illustrated in the drawings. Instead, the ribs could be set an angles with respect to the longitudinal axis of the draft sill. For example, four vertical ribs could be provided, each defining a forty-five degree angle with the longitudinal axis of the draft sill so that the vertical ribs are offset from longitudinal axis. Other numbers and dispositions of vertical ribs are possible and are within the scope of the invention.

As shown in FIGS. 4–5, 8, 11, and 17–18, a horizontal center plate rib 256 may be provided in the interior of the draft sill in the area above the center plate 116. As shown in FIGS. 4, 5, 8, 11 and 17–18, the horizontal center plate rib 256 may extend from the side walls 108 at the juncture of the side walls and the side vertical ribs 252 to the front and back vertical ribs 244, 248 and to the upper open member 242. As shown in FIG. 4, the illustrated horizontal center plate rib 256 has a curved front edge 258 and a curved back edge 260, both edges 258, 260 curving inward toward the upper open member 242 from the junctions with the side walls 108. The illustrated horizontal center plate rib edges 258, 260 are tangent with the edges 246, 250 of the front and rear vertical ribs 244, 248. As shown in FIGS. 4, 8, 11 and 17, the horizontal center plate rib 256 may be substantially centered in the draft sill, that is, it may be positioned in the plane of the anticipated force line 148. As illustrated in FIGS. 5, 8 and 17, the interior 118 of the draft sill may be free from any other horizontal rib between the horizontal center plate rib 256 and the top wall 106 and between the horizontal center plate rib 256 and the center plate 116 or bottom wall 114. The illustrated horizontal center plate rib 256 intersects the vertical side ribs 252 between the vertically aligned oval lightener holes 254. As shown in FIG. 5, a portion of the horizontal center plate rib front edge 258 may be between the rear stop 122 and the vertical center plate ribs 244, 248, 252, and the horizontal center plate rib 256 may be spaced from the inward facing surface 198 of the rear central rib 186, as well as from the top rib 188 and bottom rib 190.

As shown in FIGS. 5 and 17, there may be a space between the rear central rib 186 and front vertical center plate rib 244 and horizontal center plate rib 256 that is free from any ribs. It should be understood that in some environments, such as in a shorter draft sill, it may be desirable to connect the rear central rib 186 and the horizontal center plate rib 256, to provide, for example, a continuous horizontal rib or to provide a connected horizontal rib with lightener holes.

As shown in FIG. 8, the curved part of the back edge 260 of the illustrated horizontal center plate rib 256 may meet the side walls 108 at positions spaced from the back end 104 of the draft sill, and the side walls 108 may have thickened areas 262 between lines 264 corresponding in position with the top and bottom surfaces 266, 268 of the horizontal center plate rib 256 to the back end 104 of the draft sill.

In the embodiment of FIGS. 4–9, 11 and 16–18, the horizontal center plate rib 256 has a thickness of about one-half inch throughout its length. In the prior art, there were typically a plurality of horizontal ribs above the center plate, each having a thickness of about three-quarters of an inch.

It should be understood that the horizontal center plate rib 256 may have a size, shape and position other than as shown, and that other features of the invention may be used without using the illustrated single horizontal center plate rib. For example, the lightener holes 220, 221 of the present invention may be used with or without the illustrated single horizontal center plate rib 256. In addition, the single horizontal center plate rib 256 of the present invention may be used alone or with some or all of the other inventive features of the present invention.

As shown in FIGS. 4, 16 and 18, the illustrated embodiments of the present invention also provide for a pair of additional vent holes 270 in the bottom wall 114 of the draft sill. These vent holes 270 are sized and positioned to allow single cores to be used in this area for casting the draft sill. Use of these vent holes 270 also lowers the weight of the casting, and provides venting during casting of the draft sill. In the illustrated embodiment, each vent hole 270 has a diameter of about 3 inches, with its center spaced about 2.75 inches from the longitudinal centerline of the draft sill, and has a raised annular area 271 about one-half inch wide on the bottom wall of the draft sill. It should be understood that it is not necessary to use two vent holes, or to use circular holes as shown in FIGS. 4 and 13; other shapes, positions and number of holes may be used, including a single hole, and it is not necessary to incorporate this feature into a cast draft sill that utilizes one or more of the other features of the present invention. Other features of the invention may be used without the vent holes 270, and the vent holes 270 of the illustrated embodiment may be used alone, with some, or with all of the other features of the present invention.

The walls of the cast draft sill may have features known in the art. For example, the side vertical ribs 252 may have thickened areas near their junctures with the center plate 116. All of the dimensions and shapes may be optimized using standard finite element analysis to ensure that a cast draft still of adequate strength and minimum weight is produced. For example, the center plate thickness may be adjusted to the minimum accepted by the AAR.

Some strength and weight savings advantages may also be obtained through adjustments made to the side flanges 112. As shown in FIGS. 4 and 16, the side flanges of the present invention have straight, parallel outer edges that remain parallel from the back end to a position forward of the front stops. In contrast, in the prior art embodiment shown in FIG. 2, the side flanges flared outward between the rear stop and the center plate so that the distance between the side flange outer edges at the center plate was greater than the distance between the side flange outer edges forward of the rear stop. In the embodiments of FIGS. 4 and 16, the maximum overall width of the draft sill between the side flanges' outer edges is about 20.85 inches; it should be understood that this dimension is given for purposes of illustration only, and that the invention is not limited to this size and shape of side flange.

Another possible change in the side flanges 112 is shown in FIG. 16. In that embodiment, the outer edges of the side flanges remain parallel to each other and do not converge inwardly to a point about 6 inches from the front end 102 of the draft sill. In contrast, as shown in FIG. 2, the prior art side flanges 50 typically commenced converging inward from points nearer the front draft stop 54. In maintaining a wider flange throughout a greater length of the area between the front stop 54 and the front end 40, the embodiment illustrated in FIG. 16 should provide increased lateral stiffness in this area.

In the embodiment of FIG. 16, another change may be made to the side walls 108 between the front end 102 and a point rearward of the front stops 120. As seen in FIG. 16, the outer surface 300 of each side wall in this area is a substantially planar surface between the top wall 106 and the side flanges 112. In contrast, as seen in the embodiment of FIG. 4, the outer surface 300 of the side wall is stepped or has a radius outward between the top wall 106 and the flanges 112. In the embodiment of FIG. 16, the inner surface 302 of the side wall 108 may be stepped or have a radius inward.

To further reduce the weight of the draft sill end casting, it may also be desirable to thin the side flanges. The side flanges may have a thickness of about three-quarters of an inch along a substantial part of their length, thickening to about seven-eighths of an inch between the rear stops 122 and the center plate 116 and continuing at seven-eighths thickness to the back end 104 of the sill, so that the side flanges have a thickness of about seven-eighths inch in the area of the draft sill to be crossed by the sole plate so that the draft sill may be used interchangeably with fabricated draft sills. The two thicknesses may be joined by an intermediate section of gradually increasing thickness. Alternatively, the entire length of the side flange may have a reduced thickness if desired. It should be understood that these dimensions, like others in this description, are given for purposes of illustration only and the invention is not limited to draft sills having these dimensions.

Use of the principles of the present invention should allow for the production of a cast draft sill structure that weighs substantially less than the prior art structures, approaching the weight of a fabricated draft sill. For example, the weight of a cast draft sill according to the present invention and made of Grade B cast steel may be about 1230 pounds, compared to prior art cast draft sills with weights of 1400–1500 lbs., and compared to fabricated draft sills weighing about 1255 pounds. And with this reduced weight, the cast draft sill of the present invention exceeds any minimum AAR standards and test protocols, such as those set forth in AAR Chapter 4 related to loads borne by components.

It should be understood that the principles of the present invention may be applied to draft sills of different overall lengths, and that the weight of the cast draft sill will vary depending on the overall length of the sill. In addition, for cast draft sills with shorter or longer overall lengths than the illustrated embodiments, there may be changes in the sizes and shapes of the ribs sets 134, 184. For example, with a shorter cast draft sill, the rear central rib 186 of the rear rib set 184 may be lade to be co-extensive with the center plate horizontal rib 256; in addition, the planes 156, 166, 168, 202, 203, 213 of the top 140, 188 and bottom ribs 142, 190 of the front and back ribs sets 134, 184 may define steeper angles with the planes of the top wall 106 and bottoms 109 of the draft sill.

The draft sill of the present invention may be made using standard casting technology and may be made of standard grades of steel. As indicated, the vent holes 270 are expected to be advantageous during casting for providing openings for core supports and for providing a path for the escape of gases during casting.

While only specific embodiments of the invention have been described and shown, it is apparent that various alternatives and modifications can be made thereto. Those skilled in the art will also recognize that certain additions can be made in these illustrative embodiments. It is, therefore, the intention in the appended claims to cover all such alternatives, modifications and additions as may fall within the true scope of the invention.

We claim:

1. A draft sill to receive a shank of a device for connecting one railroad car to another, the draft sill comprising:

a pair of spaced side walls, each side wall having a top and a bottom and a surface facing the opposite side wall;

an interior defined by the facing surfaces of the side walls;

a theoretical force line corresponding with a design position for a longitudinal center line of the shank of the connecting device when received in the interior of the draft sill;

a pair of front stops on the side walls in the interior of the draft sill, one front stop extending from each side wall toward the other;

a pair of rear stops on the side walls in the interior of the draft sill, one rear stop extending from each side wall toward the other;

the front and rear stops being separated from each other, the space between the front and rear stops defining a pocket;

a lightener hole extending through each side wall of the draft sill between the front and rear stops on that side wall;

wherein each lightener hole has a centerline in the side wall and wherein the theoretical force line is between the lightener hole centerline and the bottoms of the side walls.

2. The draft sill of claim 1 wherein a neutral axis within the draft sill pocket is between the bottoms of the side walls and a plane between the theoretical force line and the tops of the side walls and less than about 0.60 inches from the theoretical force line.

3. The draft sill of claim 1 further including follower guide pads on the side walls in the pocket of the draft sill, the lightener hole extending through the follower guide pads and side walls.

4. The draft sill of claim 3 wherein there are two lightener holes in each side wall in the pocket of the draft sill, each lightener hole being surrounded by the guide pads.

5. The draft sill of claim 1 wherein each lightener hole defines an open area, and wherein the total open area in the side walls of the pocket is greater than about 38.18 square inches.

6. The draft sill of claim 5 wherein each lightener hole has an open area of at least about 32 square inches.

7. The draft sill of claim 1 wherein there are two lightener holes in each side wall and wherein each lightener hole has an open area greater than about 32 square inches.

8. The draft sill of claim 1 wherein there are two lightener holes in each side wall and the centerline of each lightener hole is between the theoretical force line and the top of each side wall of the draft sill.

9. The draft sill of claim 1 wherein the draft sill includes a key slot in each side wall between the front stop and the front end of the draft sill and the theoretical force line lies in a plane substantially centered in the key slots.

10. A cast draft sill comprising:

a pair of spaced side walls, each side wall having a top and a bottom and a surface facing the opposite side wall;

an interior defined by the facing surfaces of the side walls;

a pair of front stops on the side walls in the interior of the draft sill, the front stops extending toward one another;

a pair of rear stops on the side walls in the interior of the draft sill, the rear stops extending toward one another;

the front and rear stops being separated from each other, the space between the front and rear stops defining a pocket;

a lightener hole extending through each side wall of the draft sill between the front and rear stops on that side wall;

wherein the total open area defined by the lightener holes in the side walls between the front stops and rear stops is greater than about 38.18 square inches.

11. The draft sill of claim 10 wherein two lightener holes are in each side wall.

12. The draft sill of claim 10 wherein two lightener holes are in each side wall and each lightener hole has an open area greater than about 19.09 square inches.

13. The draft sill of claim 10 wherein the total open area of the lightener holes is at least about 64 square inches in each side wall.

14. The draft sill of claim 13 wherein the draft sill is to receive a shank of a device for connecting one railroad car to another, and wherein the lightener hole has a centerline and the draft sill has a theoretical force line corresponding with a design position for a longitudinal centerline of the shank of the connecting device when received in the interior of the draft sill, wherein the theoretical force line is between the bottom portion of the draft sill and the centerline of the lightener hole.

15. A draft sill for use with a railroad car, the draft sill comprising:

a front end;

a back end opposite the front end;

a top wall;

a pair of side walls depending from the top wall, each side wall having a bottom opposite the top wall;

an interior defined by the side walls and top wall;

a front stop on each side wall and within the interior of the draft sill, the front stops on the two side walls being opposed to each other and extending toward one another in the interior of the draft sill;

a rear stop on each side wall and within the interior of the draft sill, the rear stops on the two side walls being opposed to each other and extending toward one another in the interior of the draft sill;

a front rib set associated with each front stop, each front rib set including:

top and bottom key slot ribs extending from the front stop toward the front end of the draft sill, the top and bottom key slot ribs having spaced substantially parallel surfaces separated by a key slot in the side wall, the key slot having a central axis parallel with the top wall of the draft sill;

a front top rib extending from the front stop to the top wall and the side wall, the front top rib having a bottom surface, the front top rib being shaped so that a plane parallel with a length of the front top rib bottom surface defines an acute angle with the plane of the top wall, the front top rib being the only rib between the top key slot rib and the top wall of the draft sill;

a front bottom rib extending from the front stop toward the front end and toward the bottom of the side wall, the front bottom rib having a top surface, the front bottom rib top surface being shaped so that a plane parallel with a length of the front bottom rib top surface defines an acute angle with the plane of the bottoms of the side walls of the draft sill, the front bottom rib being the only rib between the bottom key slot rib and the bottom of the side wall; and a rear rib set associated with each rear stop.

16. The lightweight draft sill of claim 15 wherein the front bottom rib has a bottom surface and the front bottom rib is shaped so that a plane parallel with a length of the front bottom rib bottom surface defines an acute angle with the plane of the bottoms of the side walls, the front bottom rib bottom surface meeting the front stop at a position spaced from the plane of the bottoms of the side walls.

17. The draft sill of claim 15 wherein each rear rib set includes:

a rear central rib extending from the rear stop toward the back end of the draft sill, the rear central rib joining the side wall and having a back end opposite the juncture with the rear stop, the central rib having top and bottom surfaces;

a rear top rib extending from the rear stop toward the top wall and toward the side wall, the rear top rib having a bottom surface shaped so that a plane tangent with a length of the bottom surface defines an acute angle with the plane of the top wall; and a rear bottom rib extending from the rear stop toward the bottom of the side wall, the rear bottom rib having a top surface and a bottom surface, both surfaces being shaped so that a plane tangent with a length of the top surface defines an acute angle with the plane of the bottoms of the side walls and a plane tangent with a length of the rear bottom rib bottom surface defines an acute angle with the plane of the bottoms of the side walls.

18. The draft sill of claim 17 further including:

a bottom wall extending between portions of the bottoms of the side walls;

a center plate depending from the bottom wall between the rear stop and the back end of the draft sill;

a plurality of vertical center plate ribs extending between the center plate and the top wall;

the rear central rib including an inward-facing surface between the top and bottom surfaces.

19. The draft sill of claim 18 further comprising a horizontal center plate rib substantially parallel to the top wall and perpendicular to the vertical center plate ribs, the horizontal center plate rib extending between the side walls, the horizontal center plate rib having an edge between the rear stop and the vertical center plate ribs, the horizontal center plate rib edge being spaced from the rear central rib inward-facing surface, the rear top rib and the rear bottom rib.

20. The draft sill of claim 17 wherein the rear central rib has top and bottom surfaces tapering toward each other between the rear stop and the back end of the rear central rib.

21. The lightweight draft sill of claim 15 further comprising a transverse carrier rib extending across the draft sill and wherein a front bottom rib surface merges into the transverse carrier rib.

22. A draft sill for use with a railroad car, the draft sill comprising:

a front end;

a back end;

a pair of spaced side walls, each side wall having a top and a bottom and a surface facing the other side wall, the tops of the side walls being substantially co-planar, and the bottoms of the side walls being substantially co-planar;

an interior defined by the facing surfaces of the side walls;

a front stop on each side wall and within the interior of the draft sill, the front stops on the two side walls being opposed to each other and extending toward one another in the interior of the draft sill;

a rear stop on each side wall and within the interior of the draft sill, the rear stops on the two side walls being opposed to each other and extending toward one another in the interior of the draft sill;

a front rib set associated with each front stop;

a rear rib set associated with each rear stop, each rear rib set including:

a rear central rib extending from the rear stop toward the back end of the draft sill, the rear central rib joining the side wall and having a back end spaced from the juncture with the rear stop, the central rib having top and bottom surfaces, the rear central ribs of the two rear rib sets being at substantially the same level;

a rear top rib extending from the rear stop toward the side wall, the rear top rib having a bottom surface shaped so that a plane parallel with a length of the bottom surface defines an acute angle with the plane of the tops of the side walls;

the rear top rib being the only rib between the central rib and the top of the side wall along the rear stop; and a rear bottom rib extending from the rear stop toward the bottom of the side wall of the draft sill, the rear bottom rib having a top surface shaped so that a plane parallel with a length of the top surface defines an acute angle with the plane of the bottoms of the side walls;

the rear bottom rib being the only rib between the rear central rib and the bottom of the side wall along the rear stop;

the draft sill further including:

a center plate between the rear stop and the back end of the draft sill;

an open member extending upward from the center plate to a level beyond the level of the two rear center ribs; and a plurality of vertical center plate ribs extending between the open member and the side walls and upward from the center plate along at least a substantial part of the length of the open member;

wherein the back ends of the rear central ribs are spaced from the open member and vertical center plate ribs;

and wherein the back ends of the rear central ribs are free from any connection extending transversely across the interior of the draft sill between the back ends of the rear central ribs.

23. The draft sill of claim 22 wherein the rear bottom rib has a bottom surface shaped so that a plane parallel with a length of the rear bottom surface defines an acute angle with the bottom plane of the bottoms of the side walls.

24. The draft sill of claim 22 further including:

a bottom wall between portions of the bottoms of the side walls;

and wherein the center plate depends from the bottom wall of the draft sill;

and wherein each rear central rib has an inward-facing surface between the top and bottom surfaces.

25. The draft sill of claim 24 further comprising a horizontal center plate rib substantially parallel to the bottom wall and perpendicular to the vertical center plate ribs, the horizontal center plate rib extending between the side walls, the horizontal center plate rib having an edge with a portion disposed between the rear stop and the vertical center plate ribs, the horizontal center plate rib edge being spaced from the rear central rib inward-facing surface, the rear top rib and the rear bottom rib.

26. The draft sill of claim 24 wherein the rear central rib has top and bottom surfaces tapering toward each other between the rear stop and the back end of the rear central rib.

27. The draft sill of claim 24 wherein the draft sill is to receive a shank of a device for connecting one railroad car to another, and wherein the draft sill has a theoretical force line corresponding with a design position for a longitudinal centerline of the shank of the connecting device when received in the interior of the draft sill, the rear central rib being in the plane of the theoretical force line.

28. The draft sill of claim 25 wherein the draft sill is to receive a shank of a device for connecting one railroad car to another, and wherein the draft sill has a theoretical force line corresponding with a design position for a longitudinal centerline of the shank of the connecting device when received in the interior of the draft sill, the horizontal center plate rib being in the plane of the theoretical force line.

29. A draft sill for use with a railroad car, the draft sill comprising:

a front end;

a back end;

a pair of spaced opposed side walls;

each side wall having a top, a bottom and a surface facing the opposite side wall, the tops of the side walls being at one level;

a bottom wall extending between a portion of the bottoms of the side walls;

a center plate depending from the bottom wall;

an interior defined by the facing surfaces of the side walls;

a front stop on each side wall and within the interior of the draft sill, the front stops on the two side walls being opposed to each other and extending toward one another in the interior of the draft sill;

a rear stop on each side wall and within the interior of the draft sill, the rear stops on the two side walls being opposed to each other and extending toward one another in the interior of the draft sill;

a rear rib set associated with each rear stop, each rear rib set including:

a rear central rib extending from the rear stop toward the back end of the draft sill, the rear central rib joining the side wall and having a back end opposite the juncture with the rear stop;

a rear top rib on one side of the rear central rib;

a rear bottom rib on the other side of the rear central rib;

an open member extending up from the center plate toward the level of the tops of the side walls between the rear rib set and the back end of the draft sill;

a vertical center plate rib extending up from the center plate toward the level of the tops of the side walls and disposed between the open member and the rear rib set; and a horizontal center plate rib extending between the side walls and the vertical center plate rib, the horizontal center plate rib being spaced from the back ends of the rear central ribs;

wherein a space between the rear central ribs and vertical center plate rib and horizontal center plate rib and extending from side wall to side wall and from a level above the rear central ribs to a level below the rear central ribs is free from any ribs.

30. A draft sill comprising:

a front end;

a back end;

a top wall;

side walls depending from the top wall;

a bottom wall extending between a portion of the side walls;

an interior defined by the side walls and top wall;

a center plate depending from the bottom wall;

a vertical rib extending between the top wall and the center plate;

a horizontal center plate rib substantially parallel with the top wall and extending between the side walls and the vertical rib, the horizontal center plate rib being positioned substantially midway between the top wall and the bottom wall;

the interior of the draft sill between the horizontal center plate rib and the top wall being free from horizontal ribs and the interior of the draft sill between the horizontal center plate rib and the bottom wall being free from horizontal ribs.

31. A draft sill comprising:

a front end;

a back end;

spaced opposing side walls having aligned key slots having a common central plane, each side wall including a top, a bottom and a surface facing the opposite side wall;

a bottom wall extending between a portion of the side walls;

an interior defined by the facing surfaces of the side walls;

a center plate depending from the bottom wall;

a horizontal center plate rib substantially parallel with the bottom wall and extending between the side walls substantially along the central plane of the key slots;

a vertical rib extending upward from the center plate beyond the horizontal central plate rib;

the interior of the draft sill between the horizontal center plate rib and the tops of the side walls being free from horizontal ribs and the interior of the draft sill between the horizontal center plate rib and the bottom wall being free from horizontal ribs.

32. A draft sill comprising:

a top wall;

a pair of side walls depending from the top wall;

an interior defined by the side walls and top wall;

a front stop on each side wall in the interior of the draft sill, the front stops extending from the side walls toward one another;

a rear stop on each side wall in the interior of the draft sill, the rear stops extending from the side walls toward one another;

the front and rear stops being separated from each other, the space between the front and rear stops defining a pocket;

each front and rear stop having a stop face perpendicular to the side wall and lying in a plane perpendicular to the top wall;

wherein said front stops each have a recess between the stop and the top wall of the draft sill so that the stop faces of said front stops are spaced from the top wall of the draft sill.

33. The draft sill of claim 32 wherein the side walls have bottom edges and the stop faces of said front pair of stops are spaced from the bottom edges of the side walls.

34. The draft sill of claim 32 wherein all of the stops have recesses between the stops and the top wall of the draft sill.

35. A cast draft sill comprising:

a top wall;

a pair of side walls depending from the top wall;

an interior defined by the side walls and top wall;

a front stop on each side wall in the interior of the draft sill, the front stops extending from the side walls toward one another, the front stops defining a first pair of stops;

a rear stop on each side wall in the interior of the draft sill, the rear stops extending from the side walls toward one another, the rear stops defining a second pair of stops;

the front pair of stops and the rear pair of stops being separated from each other, the space between the front pair of stops and the rear pair of stops defining a pocket;

each front stop and each rear stop having a stop face intersecting the adjacent side wall;

wherein each stop of at least one pair of said first and second pairs of stops has a recess between the stop and the top wall of the draft sill so that the stop faces are spaced from the top wall of the draft sill, each recess including a radius at the top wall of the draft sill and an angled portion extending from the radius to the nearest stop face, the angled portion lying in a plane intersecting the nearest stop face; and wherein the front stops, the rear stops, the side walls and the top wall comprise a one-piece casting.

36. A cast draft sill for receiving a connecting device having a shank and a longitudinal centerline along the shank, the cast draft sill including:

a front end having an opening for receiving the connecting device;

a back end;

a theoretical force line corresponding with a design position for the longitudinal center line of the shank of the connecting device when received in the draft sill;

spaced opposing side walls, each side wall having a top and a bottom and a surface facing the other side wall;

a bottom wall extending between a portion of the side walls;

an interior defined by the facing surfaces of the side walls;

a center plate depending from the bottom wall;

an open member extending upward from the center plate to the level of the tops of the side walls;

a pair of vertical side center plate ribs between the side walls and the open member;

aligned front and rear vertical center plate ribs, the front vertical center plate rib extending from the open member toward the front end of the draft sill, the rear vertical center plate rib extending from the open member toward the rear end of the draft sill, the front vertical center plate rib including a front edge and the rear vertical center plate rib including a rear edge, the distance between at least parts of the front and rear edges being less than the diameter of the center plate;

a horizontal center plate rib extending between the side walls to the open member, the side vertical center plate ribs and front and rear vertical center plate ribs, the horizontal center plate rib extending substantially along the theoretical force line of the draft sill;

the side vertical center plate ribs extending upward from the center plate beyond the level of the horizontal center plate rib;

the interior of the draft sill between the horizontal center plate rib and the tops of the side walls being free from horizontal ribs and the interior of the draft sill between the horizontal center plate rib and the bottom wall being free from horizontal ribs;

the draft sill from the front end to the back end and including the side walls, bottom wall, center plate, open member, vertical side center plate ribs, front vertical center plate rib, rear vertical center plate rib and horizontal center plate rib comprising a one-piece casting.

37. The draft sill of claim 36 wherein each vertical side center plate rib includes two lightener holes, one lightener hole on each side of the horizontal center plate rib.

38. The draft sill of claim 37 wherein each lightener hole has an oval shape.

39. The draft sill of claim 36 wherein the horizontal center plate rib has a thickness of less than about 0.75 inches.

40. A draft sill for use with a railroad car, the draft sill comprising:

a front end;

a back end opposite the front end;

a pair of spaced opposing side walls, each side wall having a top and a bottom and a surface facing the opposite side wall, the tops of the two side walls lying in a plane and the bottoms of the side walls lying in a separate plane;

an interior defined by the facing surfaces of the side walls;

a front stop on each side wall and within the interior of the draft sill, the front stops on the two side walls being opposed to each other and extending toward one another in the interior of the draft sill;

a rear stop on each side wall and within the interior of the draft sill, the rear stops on the two side walls being opposed to each other and extending toward one another in the interior of the draft sill;

a front rib set associated with each front stop, each front rib set including:

top and bottom key slot ribs extending from the front stop toward the front end of the draft sill, the top and bottom key slot ribs having spaced substantially parallel surfaces separated by a key slot in the side wall, the key slot having a central axis parallel with the plane of the bottoms of the side walls of the draft sill;

a front top rib extending from the front stop toward the front end and toward the side wall, the front top rib having a bottom surface, the front top rib being shaped so that a plane parallel with a length of the front top rib bottom surface defines an acute angle with the plane of the tops of the side wall, the front top rib being the only rib between the top key slot rib and the top of the side wall of the draft sill;

a front bottom rib extending from the front stop toward the front end and toward the side wall, the front bottom rib having a top surface, the front bottom rib top surface being shaped so that a plane parallel with a length of the front bottom rib top surface defines an acute angle with the plane of the bottoms of the side walls of the draft sill, the front bottom rib being the only rib between the bottom key slot rib and the bottom of the side wall; and a rear rib set associated with each rear stop.

* * * * *